US008082897B2

(12) United States Patent
Kato et al.

(10) Patent No.: US 8,082,897 B2
(45) Date of Patent: Dec. 27, 2011

(54) PLASMA JET IGNITION PLUG AND IGNITION DEVICE FOR THE SAME

(75) Inventors: Tomoaki Kato, Aichi (JP); Toru Nakamura, Aichi (JP); Yuichi Yamada, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 253 days.

(21) Appl. No.: 12/452,109

(22) PCT Filed: Jun. 13, 2008

(86) PCT No.: PCT/JP2008/060878

§ 371 (c)(1),
(2), (4) Date: Dec. 15, 2009

(87) PCT Pub. No.: WO2008/156035

PCT Pub. Date: Dec. 24, 2008

(65) Prior Publication Data

US 2010/0102728 A1 Apr. 29, 2010

(30) Foreign Application Priority Data

Jun. 19, 2007 (JP) ..... 2007-161356

(51) Int. Cl.
*F02B 1/12* (2006.01)
*H01T 13/20* (2006.01)

(52) U.S. Cl. ..... 123/169 EL; 123/143 R

(58) Field of Classification Search ..... 315/111.121, 315/111.71, 209 M, 209 PZ; 123/143, 169 P, 123/169 EL, 169 RR
See application file for complete search history.

(56) References Cited

U.S. PATENT DOCUMENTS

| | | | | |
|---|---|---|---|---|
| 4,224,554 | A * | 9/1980 | Nishio et al. | 315/53 |
| 4,388,549 | A | 6/1983 | Bensman | 313/138 |
| 5,103,136 | A * | 4/1992 | Suzuki et al. | 315/59 |
| 5,371,436 | A * | 12/1994 | Griswold et al. | 315/58 |
| 6,411,038 | B2 * | 6/2002 | Murai et al. | 315/55 |
| 2006/0137642 | A1 | 6/2006 | Artmann et al. | 123/169 |

FOREIGN PATENT DOCUMENTS

| | | |
|---|---|---|
| DE | 10331418 | 1/2005 |
| GB | 2086986 | 5/1982 |
| JP | 2-72577 | 3/1990 |
| JP | 2006-294257 | 10/2006 |
| JP | 2007-141786 | 6/2007 |
| WO | WO 2005/005819 | 1/2005 |

OTHER PUBLICATIONS

International Search Report for International Application No. PCT/JP2008/060878, Sep. 16, 2008.

* cited by examiner

*Primary Examiner* — Douglas W Owens
*Assistant Examiner* — Minh D A
(74) *Attorney, Agent, or Firm* — Kusner & Jaffe

(57) ABSTRACT

The cavity of a plasma jet ignition plug is configured in a stepped shape; i.e., composed of a constricted portion and a diameter-increased portion (65). The inner diameter (B) of the constricted portion is made smaller than the inner diameter (A) of the diameter-increased portion. Further, as measured along the direction of the axis O, the length (Y) of the constricted portion is made equal to or greater than the length (X) of the diameter-increased portion. This configuration suppresses a pressure loss produced when the generated plasma expands within the cavity. As a result, the energy of the plasma at the time of jetting is increased, and the igniting performance for an air-fuel mixture can be improved.

7 Claims, 10 Drawing Sheets

PLASMA JET IGNITION PLUG AND IGNITION DEVICE FOR THE SAME

FIELD OF THE INVENTION

The present invention relates to a plasma jet ignition plug for an internal combustion engine which forms plasma and ignites an air-fuel mixture, and to an ignition device for the same.

BACKGROUND OF THE INVENTION

Conventionally, an internal combustion engine (for example, an automobile engine) uses a spark plug for igniting an air-fuel mixture by means of spark discharge (may be referred to merely as "discharge") as an ignition plug. In recent years, high output and low fuel consumption have been required of internal combustion engines. For example, a plasma jet ignition plug is known as an ignition plug which provides quick propagation of combustion and can reliably ignite a lean air-fuel mixture which is higher in air-fuel ratio than are air-fuel mixtures in conventional engines.

Such a plasma jet ignition plug has a small-volume discharge space called a cavity (chamber) formed as a result of a spark discharge gap between a center electrode and a ground electrode (external electrode) being surrounded by an insulator (housing) formed of ceramics or the like. When an air-fuel mixture is to be ignited by use of such a plasma jet ignition plug, first, a high voltage is applied between the center electrode and the ground electrode so as to perform spark discharge. By virtue of associated occurrence of dielectric breakdown, current can flow between the center electrode and the ground electrode at a relatively low voltage. Thus, through transition of a discharge state effected by further supply of energy between the center electrode and the ground electrode, plasma is generated within the cavity. The generated plasma is jetted through a communication hole (external-electrode hole) which is formed through the ground electrode, thereby igniting the air-fuel mixture (refer to, for example, Japanese Patent Application Laid-Open (kokai) No. 2006-294257, hereinafter referred to as Patent Document 1).

Such plasma may assume one of various geometrical shapes; for example, the form of a flame column when it is jetted from the cavity (hereinafter the shape of such plasma will be referred to as a "flame shape"). Since flame-shaped plasma extends in the direction of jetting, the area of contact with the air-fuel mixture is large so that the plasma exhibits high igniting performance. A known technique for further improving the performance of igniting the air-fuel mixture is increasing the jetting length of the jetted plasma. In Patent Document 1 as well, an attempt is made to increase the jetting length of plasma by means of changing the volume and shape of the cavity in various manners.

However, in order to meet a demand for an improvement of fuel efficiency of an internal combustion engine, there has in turn been demanded an ignition plug which exhibits sufficient igniting performance even for a lean air-fuel mixture. There has been demanded an ignition plug in which plasma has an increased jetting length, and jets from the cavity more energetically to thereby ignite an air-fuel mixture more readily as described in Patent Document 1.

SUMMARY OF THE INVENTION

The present invention has been accomplished so as to solve the above-described problem, and it is an object of the present invention to provide a plasma jet ignition plug which can ignite an air-fuel mixture more readily, as well as an ignition device therefor.

According to a first mode of the present invention, there is provided a plasma jet ignition plug comprising a center electrode; an insulator which has an axial bore extending along an axial direction for holding the center electrode while accommodating a front end face of the center electrode, and a recess formed on the front-end side of the axial bore as a cavity, the recess having a wall surface defined by an inner circumferential surface of the axial bore and the front end face of the center electrode and having a volume less than 15 $mm^3$; a metallic shell surrounding and holding a radially outer circumference of the insulator; and a ground electrode electrically connected to the metallic shell and provided on the front end side of the insulator. Plasma is generated within the recess as a result of discharge between the center electrode and the ground electrode. The recess of the insulator is composed of a constricted portion which has at least a portion extending along the axial direction while maintaining a certain diameter and communicates with an opening provided at the front end side of the insulator, and a diameter-increased portion which communicates with the constricted portion, which is larger in diameter than the constricted portion, and in which the front end face of the center electrode is exposed. The recess satisfies a relation $X \leqq Y$ where X represents a length of the diameter-increased portion as measured along the axial direction, and Y represents a length of the constricted portion as measured along the axial direction.

In the plasma jet ignition plug of the first mode, the plasma generated within the cavity expands within the cavity before jetting. At that time, since the inner diameter of the constricted portion communicating with the outside of the cavity is made smaller than that of the diameter-increased portion, a loss of the pressure of the plasma, which expands within the diameter-increased portion, is suppressed. Accordingly, the pressure of the plasma within the cavity can be increased. Further, the constricted portion has a section in which the constricted portion extends along the axial direction while maintaining a certain diameter. Therefore, when the plasma passes through the constricted portion at the time of jetting, the plasma is converged about the axis. Further, the jetting direction of the plasma is aligned with the axial direction. Thus, the pressure of the plasma at the time of jetting is increased further, so that the energy of the plasma can be increased. Further, since the jetting direction of the plasma is aligned, a drop in the energy of the plasma, which drop would otherwise occur due to spreading of the plasma after jetting, can be suppressed. Accordingly, the jetting length of the plasma can be increased, and the performance of igniting an air-fuel mixture can be improved.

Preferably, the constricted portion, which is smaller in diameter than the diameter-increased portion, is formed to have a length equal to or greater than that of the diameter-increased portion as measured along the axial direction. That is, preferably, a relation $X \leqq Y$ is satisfied. In this case, when the plasma passes through the constricted portion, the shape of the plasma can be regulated such that the plasma assumes the form of a flame column (a flame-like shape) extending along the axial direction. Further, at that time, since the jetting direction of the plasma is aligned with the axial direction, the energy of the plasma at the time of jetting increases. Thus, the plasma can have a longer jetting length while maintaining high energy. Accordingly, the plasma exhibits high igniting performance for an air-fuel mixture within a combustion chamber.

Further, as in the case of a plasma jet ignition plug of a second mode of the present invention, preferably, the recess of the plasma jet ignition plug of the first mode satisfies a relation $A \leqq \phi 4.0$ mm and a relation $\phi 0.5$ mm $\leqq B \leqq \phi 41.5$ mm, where A represents an inner diameter of a part of the diameter-increased portion which part is the largest in inner diameter, and B represents an inner diameter of a part of the constricted portion which part is the smallest in inner diameter.

When the inner diameter A of the diameter-increased portion is made equal to or less than $\phi 4.0$ mm as described above, the loss of pressure caused by spread of the plasma within the diameter-increased portion in directions other than the jetting direction can be reduced. When the inner diameter B of the constricted portion is made equal to or less than $\phi 1.5$ mm, the constricted portion can have a sufficiently large diameter difference in relation to the inner diameter A of the diameter-increased portion. Thus, escape of pressure via the constricted portion at the time of expansion of the plasma within the diameter-increased portion can be suppressed. Further, in the case where the inner diameter B of the constricted portion is excessively large, the pressure per unit cross section of the plasma at the time of jetting via the constricted portion may drop even if the pressure of the plasma is increased sufficiently within the diameter-increased portion. In such a case, the plasma may fail to have a sufficient jetting length. In view of this drawback as well, preferably, the inner diameter B of the constricted portion is set to $\phi 1.5$ mm or less. Meanwhile, in the case where the inner diameter B of the constricted portion is excessively small, the loss of energy of the plasma at the time of jetting increases, and the outer diameter of the plasma at the time of jetting decreases, whereby the igniting performance may drop. Accordingly, preferably, the inner diameter B of the constricted portion is set to $\phi 0.5$ mm or greater. When the inner diameter A of the diameter-increased portion of the cavity and the inner diameter B of the constricted portion of the cavity are defined as described above, a large amount of plasma can be jetted from the cavity. Moreover, the jetting length of the plasma can be increased, and the performance of igniting an air-fuel mixture can be improved further.

Moreover, as in the case of a plasma jet ignition plug of a third mode of the present invention, preferably, the ground electrode of the plasma jet ignition plug of the first or second mode is a plate-shaped electrode which has a communication hole for establishing communication between the recess and the atmosphere, and satisfies a relation $Z<X+Y \leqq 3.0$ mm, wherein Z represents a thickness of the ground electrode as measured along the axial direction.

When the length (depth) of the entire cavity as measured along the axial direction; i.e., the sum of the length X of the diameter-increased portion and the length Y of the constricted portion, as measured along the axial direction, was set to 3.0 mm or less, it is possible to prevent the plasma from spreading in the axial direction within the cavity at the time of jetting. Thus, a loss of the pressure of the plasma at the time of jetting can be suppressed. Accordingly, a drop in the energy of the plasma can be prevented.

Further, when the plasma is jetted outward from the opening of the insulator, the plasma passes through the communication hole of the ground electrode. Therefore, in actuality, the plasma ignites an air-fuel mixture on the outer side in relation to the ground electrode. Accordingly, the plasma desirably maintains its high energy when it reaches an area on the front end side (with respect to the axial direction) of the front end face of the ground electrode. In order to realize this, preferably, a relation $Z<X+Y$ (mm) is satisfied.

Further, as in the case of a plasma jet ignition plug of a fourth mode of the present invention, preferably, the plasma jet ignition plug of the second mode satisfies a relation $X \leqq A$.

When the length X of the diameter-increased portion is made equal to or less than the inner diameter A as described above, the diameter-increased portion can assume the form of a small chamber which extends more in the radial direction than in the axial direction. In such a case, the plasma can spread in the radial direction more easily when expanding, whereby a loss of the pressure of the plasma caused by expansion toward the constricted portion side can be suppressed. Accordingly, it is possible to prevent the pressure of the plasma from lowering at the time of jetting.

Further, as in a plasma jet ignition plug of a fifth mode of the present invention, preferably, the plasma jet ignition plug of the second or fourth mode satisfies a relation $B \leqq C$, where C represents the inner diameter of the communication hole of the ground electrode.

When the inner diameter C of the communication hole of the ground electrode is made equal to or greater than the inner diameter B of the constricted portion as described above, the jetted plasma, which is aligned with the axial direction by the constricted portion, becomes less likely to come into contact with the ground electrode when the plasma passes through the communication hole. Accordingly, the heat of the plasma becomes less likely to be removed by the ground electrode, whereby a drop in the igniting performance can be suppressed.

Further, as in a plasma jet ignition plug of a sixth mode of the present invention, preferably, the plasma jet ignition plug of the second, fourth, or fifth mode satisfies a relation $0 \leqq D-B \leqq 2$ (mm), where D represents an outer diameter of a front end portion of the center electrode.

When the plasma is generated, spark discharge occurs between the center electrode and the ground electrode. When the value of D−B is set to 2 mm or less as described above, it is possible to prevent the constricted portion from being abraded through channeling, which abrasion would otherwise occur due to great projection of the constricted portion into the path of spark discharge. Further, when the value of D−B is set to 0 mm or greater, when the plasma generated within the cavity jets, it becomes possible to suppress a loss of the energy of the plasma which loss would otherwise occur as a result of escape of the pressure of the plasma toward the direction opposite the jetting direction.

Further, as in a plasma jet ignition plug of a seventh mode of the present invention, preferably, the plasma jet ignition plug of any of the first through sixth modes satisfies a relation $0.01<S/V \leqq 0.4$, where S represents a cross sectional area ($mm^2$) of the constricted portion as measured perpendicularly to the axial direction, and V represents a volume ($mm^3$) of the recess.

In the case where the value of S/V is larger than 0.01 as described above, when the plasma jets outward via the constricted portion, the ratio of the amount of the plasma jetting per unit time to the total amount of the generated plasma does not becomes excessively small. Therefore, jetting of the plasma can be performed efficiently. Further, in the case where the value of S/V is equal to or less than 0.4, when the plasma generated within the cavity expands, the pressure of the plasma does not escape via the constricted portion. Accordingly, it is possible to increase the energy of the plasma at the time of jetting and improve the igniting performance.

Further, according to an eighth mode of the present invention, there is provided an ignition device for a plasma jet ignition plug, which device comprises the plasma jet ignition plug according to the seventh mode; and a power source which supplies an energy for ignition to the plasma jet ignition plug, wherein a relation $3 \leqq E/V \leqq 200$ is satisfied, where E represents an amount of energy E (mJ) supplied from the power source.

In the case where the value of E/V is equal to or greater than 3 as described above, the plasma generated within the cavity can obtain an amount of energy suitable for the volume of the cavity. Therefore, the plasma can increase its pressure sufficiently within the cavity, whereby the energy of the plasma at the time of jetting can be increased, and, thus, the igniting performance can be improved. Further, in the case where the value of E/V is equal to or less than 200, the amount of supplied energy does not reach a saturated level, and, thus, an igniting performance corresponding to an increase in the energy of the generated plasma can be attained. Further, since the plasma jet ignition plug receives an energy which is necessary and sufficient for improvement of the igniting performance, consumption of the electrode can be suppressed sufficiently.

DETAILED DESCRIPTION OF THE INVENTION

Embodiments of a plasma jet ignition plug and an ignition apparatus (device) therefor in which the present invention is embodied will be described with reference to the drawings. First, taking a plasma jet ignition plug 100 as an example, the structure thereof will be described with reference to FIGS. 1 and 2. In the following description, the direction of the axis O of the plasma jet ignition plug 100 in FIG. 1 is referred to as the vertical direction, and the lower side of the plasma jet ignition plug 100 in FIG. 1 is referred to as the front end side of the plasma jet ignition plug 100, and the upper side as the rear end side of the plasma jet ignition plug 100.

Figure 1:
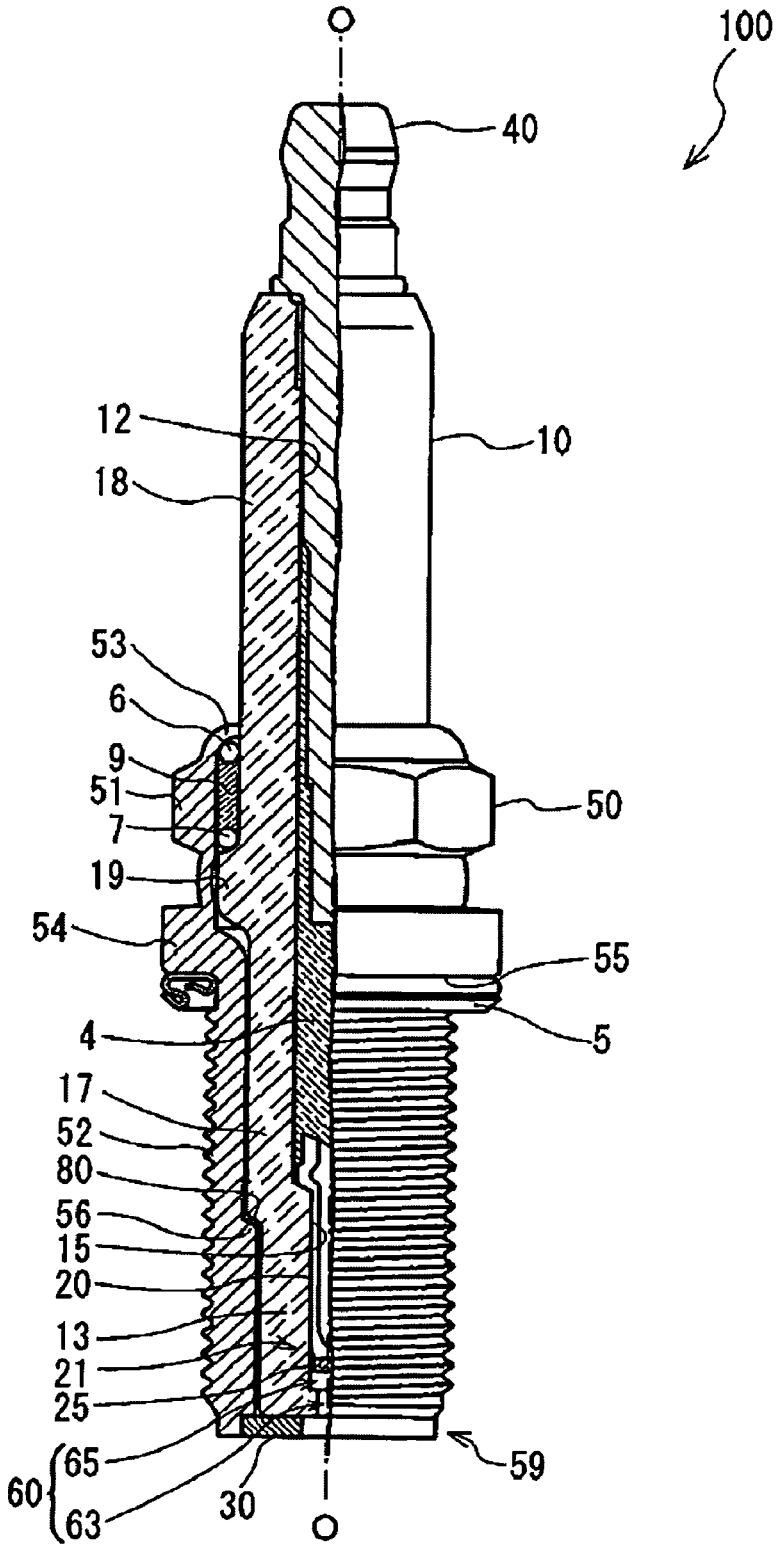
FIG. 1 is a partial sectional view of a plasma jet ignition plug 100.

As shown in FIG. 1, the plasma jet ignition plug 100 is mainly composed of an insulator 10, a metallic shell 50 which holds the insulator 10, a center electrode 20 held within the insulator 10 and extending along the direction of the axis O, a ground electrode 30 welded to a front end portion 59 of the metallic shell 50, and a terminal metal piece 40 provided in a rear end portion of the insulator 10.

As is well known, the insulator 10 is an electrically insulative member which is formed of alumina or the like by firing, and assumes the form of a tube having an axial bore 12 extending in the direction of the axis O. The insulator 10 has a flange portion 19 located substantially at the center with respect to the direction of the axis O and having the largest outer diameter, and a rear trunk portion 18 located rearward of the flange portion 19. The insulator 10 also has a front trunk portion 17 located frontward of the flange portion 19 and having an outer diameter smaller than that of the rear trunk portion 18, and a leg portion 13 located frontward of the front trunk portion 17 and having an outer diameter smaller than that of the front trunk portion 17. The insulator 10 further has a stepped portion located between the leg portion 13 and the front trunk portion 17.

Figure 2:
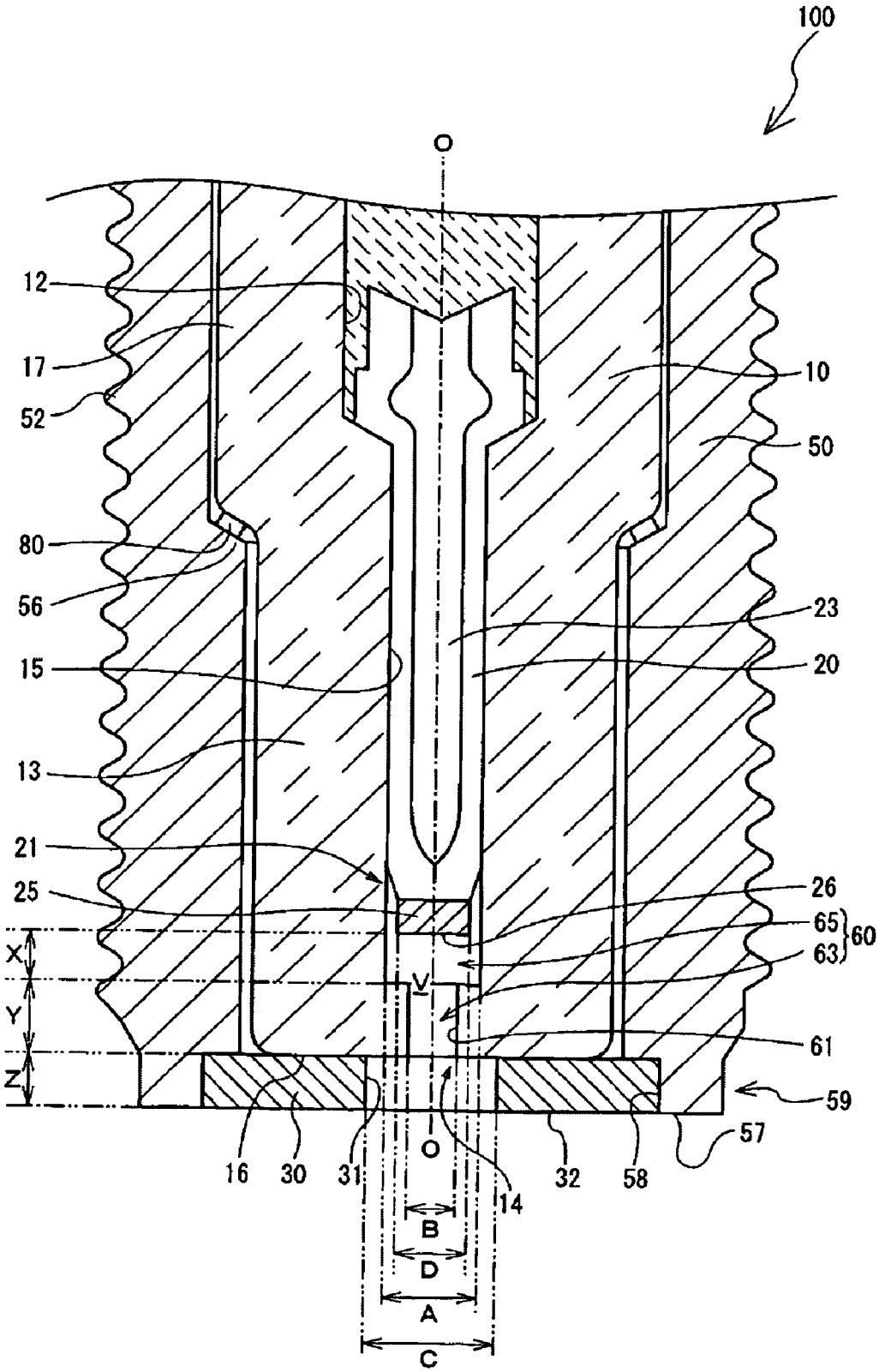
FIG. 2 is an enlarged sectional view of a front end portion of the plasma jet ignition plug 100.

As shown in FIG. 2, a portion of the axial bore 12 which corresponds to an inner circumferential region of the leg portion 13 is formed as an electrode-accommodating portion 15. The electrode-accommodating portion 15 is smaller in diameter than a portion of the axial bore 12 which corresponds to inner circumferential regions of the front trunk portion 17, the flange portion 19, and the rear trunk portion 18. The electrode-accommodating portion 15 retains the center electrode 20 therein. A portion of the axial bore 12 which is located frontward of the electrode-accommodating portion 15 is further reduced in diameter so as to serve as a front-end small-diameter portion 61. The inner circumference of the front-end small-diameter portion 61 is continuous with a front end face 16 of the insulator 10, and forms an opening 14 of the axial bore 12.

Next, the center electrode 20 is a columnar electrode rod formed of, for example, a Ni-based alloy such as INCONEL (trademark) 600 or 601. The center electrode 20 contains therein a metal core 23 formed of, for example, copper, which is excellent in thermal conductivity. A front end portion 21 of the center electrode 20 is reduced in diameter toward the front end side. A disk-like electrode chip 25 formed of an alloy which contains a noble metal or W as a main component is welded to the front end portion 21 of the center electrode 20 such that the electrode chip 25 is united with the center electrode 20. In the present embodiment, the "center electrode" encompasses the electrode chip 25 united with the center electrode 20.

A rear end portion of the center electrode 20 is increased in diameter, thereby assuming the form of a flange. The flange portion of the center electrode 20 is in contact with a stepped region of the axial bore 12, the stepped region serving as a starting point of the electrode-accommodating portion 15. Thus, the center electrode 20 is positioned within the electrode-accommodating portion 15. Further, the front end face 26 of the center electrode 20 (more specifically, the front end face 26 of the electrode chip 25, which is integrally joined to the front end portion 21 of the center electrode 20) is located rearward, with respect to the direction of the axis O, of a stepped portion between the electrode-accommodating portion 15 and the front-end small-diameter portion 61.

By virtue of this configuration, a first small chamber assuming the form of a cylindrical hole (hereinafter called a "constricted portion" 63) is formed in the plasma jet ignition plug 100. The constricted portion 63 is surrounded by the inner circumferential wall of the front-end small-diameter portion 61 of the axial bore 12. The front end of the constricted portion 63 with respect to the direction of the axis O is continuous with the opening 14 of the front end face 16 of the insulator 10, and the rear end of the constricted portion 63 with respect to the direction of the axis O communicates with the electrode-accommodating portion 15. Further, a second small chamber (hereinafter called a "diameter-increased portion" 65) is formed in the plasma jet ignition plug 100. The diameter-increased portion 65 is surrounded by the inner circumferential wall of the electrode-accommodating portion 15 and the front end face 26 of the center electrode 20. The front end of the diameter-increased portion 65 with respect to the direction of the axis O communicates with the constricted portion 63. That is, at the front end side of the electrode-accommodating portion 15, the axial bore 12 of the insulator 10 forms a recess closed by the center electrode 20. That is, a small chamber (hereinafter referred to as a "cavity" 60) is provided in the axial bore 12. The cavity 60 is composed of the constricted portion 63 and the diameter-increased portion 65, and communicates with the outside via the opening 14 of the front end face 16.

Next, as shown in FIG. 1, the center electrode 20 is electrically connected to the terminal metal piece 40 via an electrically conductive seal substance 4, which is a mixture of metal and glass and is provided in the axial bore 12. The seal substance 4 fixes the center electrode 20 and the terminal metal piece 40 in the axial bore 12 while establishing electrical connection therebetween. A high-voltage cable (not shown) is connected to the terminal metal piece 40 via a plug cap (not shown), and a high voltage is applied to the terminal metal piece 40 for causing spark discharge between the center electrode 20 and the ground electrode 30.

Next, the metallic shell 50 is a tubular metal fitting for fixing the plasma jet ignition plug 100 to the engine head of an unillustrated internal combustion engine. The metallic shell 50 surroundingly retains the insulator 10. The metallic shell 50 is formed of an iron-based material and has a tool engagement portion 51, with which an unillustrated plasma jet ignition plug wrench is engaged, and a mounting screw portion 52 to be screw-engaged with the engine head provided at an upper portion of the engine.

Also, the metallic shell 50 has a crimp portion 53 provided rearward of the tool engagement portion 51. Annular ring members 6 and 7 are disposed between a portion of the metallic shell 50 which ranges from the tool engagement portion 51 to the crimp portion 53, and the rear trunk portion 18 of the insulator 10. Furthermore, a space between the annular ring members 6 and 7 is filled with powder of talc 9. By means of crimping of the crimp portion 53, the insulator 10 is pressed frontward in the metallic shell 50 via the ring members 6 and 7 and the talc 9. Further, as shown in FIG. 2, the stepped portion between the leg portion 13 and the front trunk portion 17 is supported, via an annular packing 80, on an engagement portion 56 of the metallic shell 50 which is formed on the inner circumferential surface of the metallic shell 50 in a stepped shape. In this manner, the metallic shell 50 and the insulator 10 are united together. At this time, the packing 80 provides a gas-tight seal between the metallic shell 50 and the insulator 10, thereby preventing outflow of combustion gas via the clearance therebetween. Also, as shown in FIG. 1, a flange portion 54 is formed between the tool engagement portion 51 and the screw portion 52. A gasket 5 is fitted onto the screw portion 52 to be located near the rear end thereof; i.e., located on a seat face 55 of the flange portion 54.

Next, the ground electrode 30 is provided at the front end portion 59 of the metallic shell 50. The ground electrode 30 is formed of a metal having excellent resistance to spark-induced erosion; for example, an Ni alloy, such as INCONEL (trademark) 600 or 601. As shown in FIG. 2, the ground electrode 30 assumes the form of a circular disk, and has a communication hole 31 at the center thereof. The ground electrode 30 is engaged with an engagement portion 58 formed on the inner circumferential surface of the front end portion 59 of the metallic shell 50 in a state in which the thickness direction of the ground electrode 30 coincides with the direction of the axis O and the ground electrode 30 is in contact with the front end face 16 of the insulator 10. The entire outer circumferential edge of the ground electrode 30 is then laser-welded to the engagement portion 58 in a state in which the front end face 32 is flush with the front end face 57 of the metallic shell 50. Thus, the ground electrode 30 and the metallic shell 50 are united together. The interior of the cavity 60 communicates with the atmosphere via the communication hole 31 of the ground electrode 30.

Figure 3:
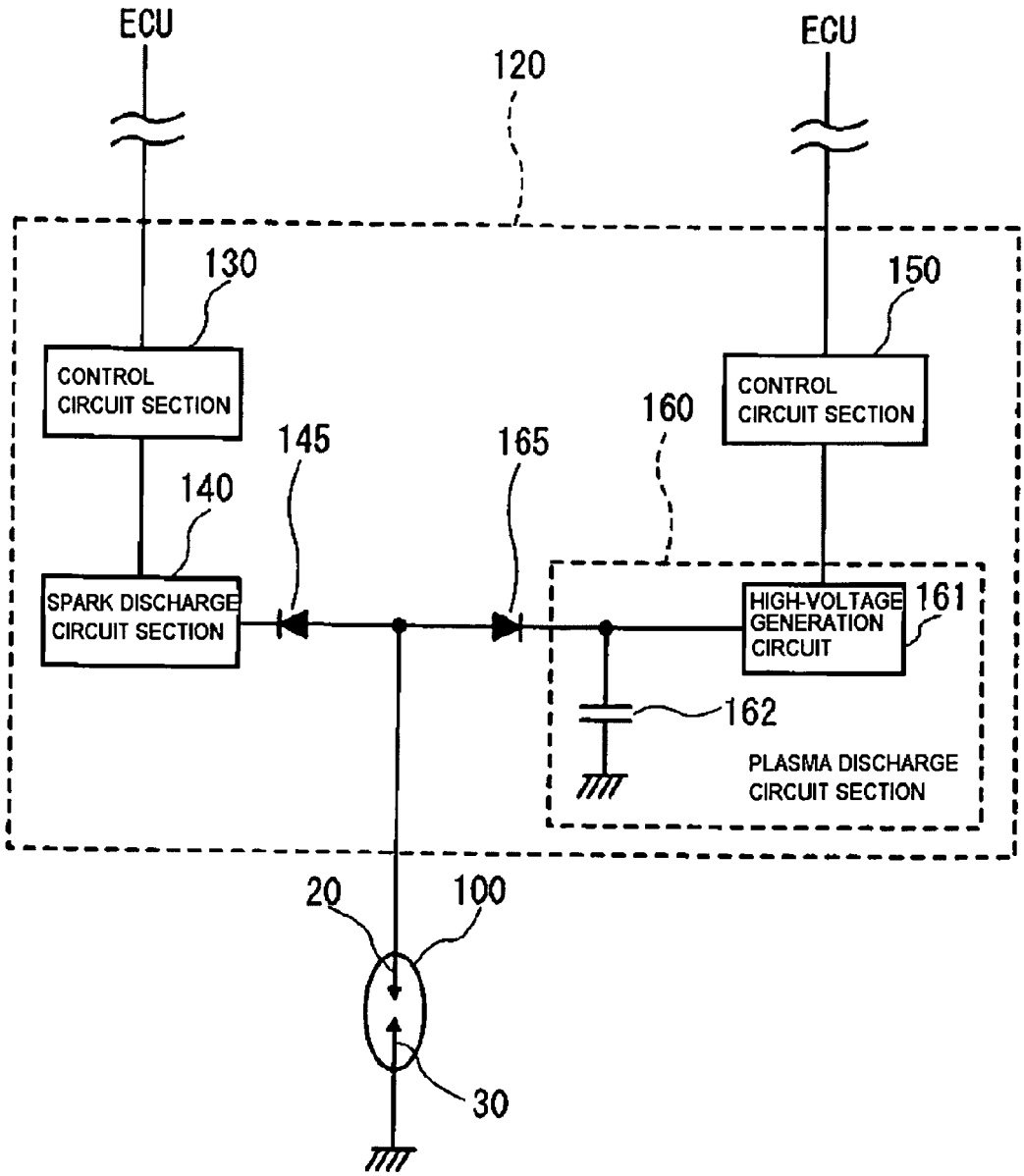
FIG. 3 is a diagram schematically showing the electrical configuration of an ignition apparatus 120 connected to the plasma jet ignition plug 100.

The plasma jet ignition plug 100 having such a configuration is connected to an ignition apparatus 120, an example of which is shown in FIG. 3, and receives electric power supplied from the ignition apparatus 120 so as to ignite an air-fuel mixture. The configuration of the ignition apparatus 120 will now be described.

The ignition apparatus 120 shown in FIG. 3 is adapted to supply electric power to the plasma jet ignition plug 100 in accordance with an instruction from an ECU so as to cause the plasma jet ignition plug 100 to jet plasma, to thereby ignite an air-fuel mixture. The ignition apparatus 120 includes a spark discharge circuit section 140, a plasma discharge circuit section 160, control circuit sections 130 and 150, and two diodes 145 and 165 for preventing reverse flow.

The spark discharge circuit section 140 is a power supply circuit section for inducing so-called trigger discharge; i.e., causing dielectric breakdown to thereby produce spark discharge through application of high voltage across the spark discharge gap. The spark discharge circuit section 140 may be a CDI-type power supply circuit. The spark discharge circuit section 140 is controlled by the control circuit section 130 connected to an ECU (electronic control circuit) of an automobile. The spark discharge circuit section 140 is electrically connected, via the diode 145, to the center electrode 20 of the plasma jet ignition plug 100 to which electric power is to be supplied. The polarity of the potential within the spark discharge circuit section 140 and the direction of the diode 145 are set such that a current flows from the ground electrode 30 to the center electrode 20 at the time of trigger discharge.

The plasma discharge circuit section 160 is a power supply circuit section for supplying a high energy to the spark discharge gap at which dielectric breakdown has occurred as a result of the trigger discharge caused by the spark discharge circuit section 140, to thereby produce plasma. As in the case of the spark discharge circuit section 140, the plasma discharge circuit section 160 is controlled by the control circuit section 150 connected to the ECU (electronic control circuit) of the automobile. Like the spark discharge circuit section 140, the plasma discharge circuit section 160 is connected, via the diode 165 for reverse flow prevention, to the center electrode 20 of the plasma jet ignition plug 100.

The plasma discharge circuit section 160 includes a capacitor 162 for storing a charge (energy), and a high-voltage generation circuit 161 for charging the capacitor 162. One end of the capacitor 162 is grounded, and the other end of the capacitor 162 is connected to the high-voltage generation circuit 161, and to the center electrode 20 via the above-mentioned diode 165. The amount of energy E (mJ) supplied to the spark discharge gap so as to jet plasma one time is the sum of the amount of energy supplied to the spark discharge gap as a result of trigger discharge and the amount of energy supplied from the capacitor 162. The capacitance of the capacitor 162 is adjusted such that the energy amount E (mJ) becomes a predetermined amount, which will be described later. Further, the polarity of the potential within the high-voltage generation circuit 161 and the direction of the diode 165 are set such that a current flows from the ground electrode 30 to the center electrode 20 as in the above-described case when energy for generation of plasma is supplied from the capacitor 162 to spark discharge gap. Notably, the ground electrode 30 of the plasma jet ignition plug 100 connected to the ignition apparatus 120 is grounded via the metallic shell (see FIG. 1).

The ignition apparatus 120 having the above-described configuration supplies electric power to the plasma jet ignition plug 100 in accordance with an ignition instruction from the ECU (in response to receipt of a control signal indicating an ignition timing). Upon receipt of electric power, the plasma jet ignition plug 100 jets plasma, to thereby ignite an air-fuel mixture. Operations of the plasma jet ignition plug 100 and the ignition apparatus 120 for igniting an air-fuel mixture will now be described.

When an air-fuel mixture is to be ignited by the plasma jet ignition plug 100 of the present embodiment during operation of an internal combustion engine, a piece of information representing an ignition timing is sent from the ECU to the control circuit section 130 of the ignition apparatus 120, which are shown in FIG. 3. In a period before the ignition timing, in the plasma discharge circuit section 160, the high-voltage generation circuit 161 and the capacitor 162, for which reverse flow is prevented by the diode 165, form a closed circuit, whereby the capacitor 162 is charged under the control of the control circuit section 150. When the spark discharge circuit section 140 is controlled by the control circuit section 130 on the basis of the information representing the ignition timing, a high voltage is applied across the spark discharge gap formed between the ground electrode 30 and the center electrode 20. Thus, dielectric breakdown occurs between the ground electrode 30 and the center electrode 20, whereby trigger discharge occurs.

When the trigger discharge causes dielectric breakdown at the spark discharge gap, current can flow across the spark discharge gap through application of a relatively low voltage thereto. Thus, the energy accumulated in the capacitor 162 is discharged and supplied to the spark discharge gap. As a result, plasma of high energy is produced within the cavity 60 shown in FIG. 2 and formed by a small space surrounded by the wall surface. The plasma assumes a so-called flame shape; i.e., a flame-column-like shape when various portions of the cavity 60 and the ground electrode 30 satisfy the respective conditions to be described later, whereby the plasma is jetted from the opening 14 of the insulator 10 toward the outside; i.e., toward a combustion chamber. Thus, the plasma ignites an air-fuel mixture within the combustion chamber, whereby a formed flame kernel grows and combustion takes place.

Meanwhile, after the energy accumulated in the capacitor 162 has been discharged, the supply of energy to the spark discharge gap ends, so that the spark discharge gap is insulated. As a result, the capacitor 162 and the high-voltage generation circuit 161 again form a closed circuit, whereby the capacitor 162 is charged. When the control circuit section 130 receives the next piece of ignition timing information, the control circuit section 130 again causes the trigger discharge to occur at the spark discharge gap, whereby flame-shaped plasma is jetted.

As described above, in the plasma jet ignition plug 100 of the present embodiment, spark discharge occurs upon application of a high voltage between the center electrode 20 and the ground electrode 30. Then, through transition of the discharge state effected by further supply of energy between the center electrode 20 and the ground electrode 30, plasma is generated within the cavity 60. When the plasma expands within the cavity 60 and its pressure increases, the plasma is jetted from the opening 14 while assuming a so-called flame shape; i.e., a flame-column-like shape.

In the present embodiment, as shown in FIG. 2, in order to increase the energy of the plasma jetted from the cavity 60, as described above, the cavity 60 has a double-chamber structure; i.e., is composed of the constricted portion 63 and the diameter-increased portion 65. As described above, by means of closing the axial bore 12 of the insulator 10 by the center electrode 20, the cavity 60 is formed as a small chamber which communicates with the outside via the opening 14 of the front end face 16 of the insulator 10. In the cavity 60, the constricted portion 63 is disposed so as to establish communication between the diameter-increased portion 65 and the outside. The constricted portion 63 has a portion having a fixed diameter and extending in the direction of the axis O (a hole portion extending straight along the axis O), and is smaller in diameter than the diameter-increased portion 65, whereby the constricted portion 63 functions as a so-called gun barrel. Further, the diameter-increased portion 65 is a small chamber having a dead end, and communicates with the outside via a passage constricted by the constricted portion 63. Thus, a pressure loss produced in a process in which the generated plasma expands is reduced.

By virtue of the above-described structure, the pressure of the plasma generated within the cavity 60 is increased particularly in the diameter-increased portion 65 when the plasma expands. Further, when the plasma is jetted toward the outside, the plasma passes through the constricted portion 63 having a reduced diameter, whereby its energy at the time of jetting increases. The plasma is then guided by the constricted portion 63 extending along the direction of the axis O, and jetted from the opening 14 toward the interior of the combustion chamber while assuming the form of a flame column (flame shape) extending along the direction of the axis O. As described above, the constricted portion 63 has a portion extending along the direction of the axis O while maintaining the predetermined diameter. Therefore, the jetting direction of the plasma is aligned with the axis O, and its energy at the time of jetting increases. Accordingly, the plasma has an increased jetting length, while maintaining high energy, to thereby exhibit enhanced performance of igniting an air-fuel mixture within the combustion chamber. Notably, since the plasma is jetted while its high energy is maintained, at the time of jetting, the circumferential wall of the opening 14 is subjected to a high temperature and a high pressure. In order to prevent the plasma from damaging the circumferential wall of the opening 14, an edge portion of the circumferential wall of the opening 14 may be chamfered. In order to enable the constricted portion 63 to function as a so-called gun barrel in such a case, preferably, the hole portion extending straight accounts for at least 80% of the length of the constricted portion 63 as measured along the direction of the axis O.

In order to allow jetting of flame-shaped plasma which exhibits enhanced igniting performance, in the present embodiment, the following requirements are set for the sizes of various portions of the cavity 60, etc., on the basis of the results of evaluation tests to be described later. As shown in FIG. 2, the length of the diameter-increased portion 65 as measured along the direction of the axis O is represented by X, that of the constricted portion 63 is represented by Y, and that of the communication hole 31 of the ground electrode 30 (that is, the thickness of the ground electrode 30) is represented by Z. Further, the inner diameter of the diameter-increased portion 65 is represented by A, the inner diameter of the constricted portion 63 is represented by B, the inner diameter of the communication hole 31 is represented by C, and the outer diameter of the front end portion 21 of the center electrode 20 (that is, the diameter of the front end face 26) is represented by D. Further, the cross sectional area of the constricted portion 63 as measured perpendicularly to the direction of the axis O is represented by S, and the volume of the cavity 60 is represented by V. Notably, the volume V of the cavity 60 refers to the sum of the volume of the constricted portion 63 and that of the diameter-increased portion 65 located frontward of the front end face 26 of the center electrode 20 with respect to the direction of the axis O. In the present embodiment, the volume V of the cavity 60 is must be less than 15 $mm^3$, and relations $B<A$ and $X \leqq Y$ must be satisfied. Also, relations $A \leqq \phi 4.0$ mm and $\phi 0.5$ mm$\leqq B \leqq 1.5$ mm must be satisfied. Furthermore, relations $Z<X+Y \leqq 3.0$ mm, $X \leqq A$, and $B \leqq C$ must be satisfied. Moreover, relations $0 \leqq D-B \leqq 2$ mm and $0.01<S/V \leqq 0.4$ must be satisfied.

First, the relation $B<A$ is desirably satisfied; that is, the inner diameter B of the constricted portion 63 of the cavity 60 is desirably smaller than the inner diameter A of the diameter-increased portion 65 of the cavity 60. When this relation is satisfied, as described above, there can be a reduction in a loss of pressure occurring particularly at the diameter-increased portion 65 when the plasma generated within the cavity 60 expands. Therefore, when the plasma jets to the outside via the constricted portion 63, a pressure sufficient for the plasma to jet energetically can be obtained.

The volume V of the cavity 60 is desirably less than 15 $mm^3$. If the volume V of the cavity 60 is increased with the amount of energy supplied to the cavity 60 maintained constant, the density of plasma within the cavity 60 drops. Accordingly, in the case where the volume V of the cavity 60 is increased, a higher energy must be supplied in order to cause the plasma to produce a sufficiently high pressure within the cavity 60 through expansion thereof.

The length Y of the constricted portion 63 as measured along the direction of the axis O is preferably equal to or greater than the length X of the diameter-increased portion 65 as measured along the direction of the axis O. In this case, since the constricted portion 63, which is smaller in diameter than the diameter-increased portion 65, is formed to be longer than the diameter-increased portion 65 as measured along the direction of the axis O, when the plasma is jetted, the plasma assumes a flame shape; i.e., the form of a flame-column extending along the direction of the axis O. Further, since the jetting direction of the plasma is aligned with the axis O and the energy of the jetted plasma increases, whereby the jetting length of the plasma can be increased, while its high energy is maintained, and the plasma exhibits enhanced performance of igniting an air-fuel mixture within a combustion chamber.

The inner diameter of A of the diameter-increased portion 65 of the cavity 60 is preferably equal to or less than ϕ4.0 mm. In the case where the inner diameter A of the diameter-increased portion 65 is larger than ϕ4.0 mm, the generated plasma spreads in the radial direction within the diameter-increased portion 65, whereby a pressure loss occurs. Therefore, it becomes difficult for the plasma to energetically jet to the outside through the constricted portion 63.

The inner diameter B of the constricted portion 63 preferably falls within a range of ϕ0.5 mm to ϕ1.5 mm, inclusive. When the inner diameter B of the constricted portion 63 is less than ϕ0.5 mm, a large load acts on plasma when the plasma jets to the outside through the constricted portion 63, whereby a large energy loss is produced. Further, the outer diameter of the jetted plasma decreases, and the igniting performance may drop. Meanwhile, when the inner diameter B of the constricted portion 63 is greater than ϕ1.5 mm, even when the pressure of the plasma is sufficiently increased within the diameter-increased portion 65, at the time of jetting, the constricted portion 63 may fail to increase the pressure of the plasma per unit cross sectional area. As a result, the plasma fails to have a sufficient jetting length, whereby its igniting performance may drop.

The total length X+Y of the diameter-increased portion 65 and the constricted portion 63 as measured along the direction of the axis O; i.e., the depth of the cavity 60, is preferably equal to or less than 3.0 mm. The greater the depth of the cavity 60, the greater the degree to which the plasma generated within the cavity 60 spreads within the cavity 60 along the direction of the axis O and the greater the pressure loss. When the pressure loss increases, the energy of the plasma jetting outward from the opening 14 may drop.

When jetting outward from the opening 14, the plasma passes through the communication hole 31 of the ground electrode 30. Therefore, in actuality, an air-fuel mixture is ignited outward of the ground electrode 30. Accordingly, after jetting from the opening 14, the plasma desirably maintains its high energy on the front end side (with respect to the direction of the axis O) of the front end face 32 of the ground electrode 30. Specifically, the relation Z<X+Y (mm) is preferably satisfied, because the plasma exhibits higher performance of igniting an air-fuel mixture when that relation is satisfied.

The shape of the diameter-increased portion 65 is preferably determined such that the length X of the diameter-increased portion 65 as measured along the direction of the axis O is equal or less than the inner diameter A of the diameter-increased portion 65. When X>A, the diameter-increased portion 65 assumes the shape of a small chamber extending more along the direction of the axis O than in the radial direction. In such case, when the plasma expands, the pressurized plasma is likely to spread toward the constricted portion 63 (along the direction of the axis O). Therefore, the energy of the plasma at the time of jetting may drop.

The inner diameter C of the communication hole 31 of the ground electrode 30 is preferably equal to or greater than the inner diameter B of the constricted portion 63. The jetting direction of the plasma is aligned with the direction of the axis O by the constricted portion 63. Therefore, when the inner diameter C of the communication hole 31 is equal to or greater than the inner diameter B of the constricted portion 63, at the time of jetting, the plasma becomes less likely to come into contact with the ground electrode 30. Accordingly, the heat of the plasma becomes less likely to be removed by the ground electrode 30, whereby a drop in the igniting performance can be suppressed.

The difference (D−B) between the outer diameter D of the front end portion 21 of the center electrode 20 and the inner diameter B of the constricted portion 63 desirably falls within a range of 0 mm to 2 mm inclusive. When the plasma is generated, spark discharge takes place between the center electrode 20 and the ground electrode 30. The greater the value of D−B, the greater the amount by which the insulator 10 projects into the passage of the spark in the constricted portion 63. When the value of D−B is greater than 2 mm, so-called channeling; i.e., a phenomenon in which the spark discharge removes the inner circumferential surface of the constricted portion 63, becomes likely to occur, possibly resulting in a drop in the stability of discharge and a drop in the heat resistance of the insulator 10. Meanwhile, when D−B is less than 0 mm, the pressure of the plasma at the time of jetting escapes rearward with respect to the direction of the axis O (that is, toward the side opposite the jetting direction), and decreases. In such a case, the plasma may fail to have a sufficient jetting length, and the igniting performance may drop.

The ratio (S/V) of the cross sectional area S of the constricted portion 63 to the volume V of the cavity 60 is desirably greater than 0.01 but not greater than 0.4. In the case where the ratio of the cross sectional area S of the constricted portion 63 to the volume V of the cavity 60 is small, the plasma, which jets to the outside via the constricted portion 63, is excessively constricted; i.e., the ratio of the amount of plasma passing through the constricted portion 63 per unit time to the total amount of the generated plasma becomes excessively small. Thus, the loss of energy increases. Specifically, when the ratio S/V becomes equal to or less than 0.01, jetting of the plasma is not performed efficiently, and the igniting performance may drop. Meanwhile, in the case where the ratio of the cross sectional area S of the constricted portion 63 to the volume V of the cavity 60 is large, when the plasma generated within the cavity 60 expands, the pressure of the plasma escapes through the constricted portion 63. Specifically, when the ratio S/V becomes greater than 0.4, the energy of the plasma at the time of jetting drops, and the igniting performance may drop.

The ratio (E/V) of the amount E of energy supplied from a power source to the volume V of the cavity 60 desirably falls within a range of 3 to 200 inclusive. In the case where the ratio (E/V) of the supplied energy amount E to the volume V of the cavity 60 is small, an amount of energy suitable for the volume V of the cavity 60 cannot be provided for the plasma generated within the cavity 60 when the plasma produces a high pressure. When the ratio E/V is less than 3, the plasma fails to increase the pressure sufficiently within the cavity 60. As a result, the energy of the plasma at the time of jetting drops, and the igniting performance may drop. Meanwhile, when the ratio of the supplied energy amount E to the volume V of the cavity 60 is increased, the energy of the generated plasma increases, and the igniting performance is improved. However, when the ratio E/V exceeds 200, saturation occurs. The ratio E/V is desirably set to be equal to or less than 200 in order to suppress consumption of the electrode.

Evaluation tests were performed in order to confirm the possibility of causing plasma to energetically jet from the opening 14 to thereby improve the performance of igniting an air-fuel mixture by means of providing requirements for the inner diameters and the lengths (as measured along the direction of the axis O) of the constricted portion 63 and the diameter-increased portion 65 of the cavity 60 and those of the ground electrode 30.

Example 1

First, there was carried out an evaluation test for checking the influence, on the igniting performance, of the relation between the inner diameter B of the constricted portion 63 and the inner diameter A of the diameter-increased portion 65. For this evaluation test, Sample (plasma jet ignition plug) 1-2 was made by use of an insulator in which the inner diameter A of the diameter-increased portion of the cavity was ϕ2.0 mm and the inner diameter B of the constricted portion was ϕ1.0 mm. Similarly, Sample (plasma jet ignition plug) 1-3 was made by use of an insulator in which the inner diameter A of the diameter-increased portion of the cavity was ϕ1.0 mm and the inner diameter B of the constricted portion was ϕ2.0 mm. Also, as a comparative example, Sample (plasma jet ignition plug) 1-1 was made by use of an insulator in which the difference in the inner diameters was made zero (both the inner diameter A of the diameter-increased portion and the inner diameter B of the constricted portion were ϕ1.0 mm). Notably, in all the samples, the length X of the diameter-increased portion and the length Y of the constricted portion (as measured along the direction of the axis O) were set to 1.0 mm. Further, a ground electrode whose thickness Z was 1.0 mm and in which the inner diameter C of the communication hole was ϕ2.0 mm was used in each sample.

Each sample was individually attached to a six-cylinder engine for testing, and was connected to an ignition apparatus capable of supplying energy of 150 mJ. An air-fuel mixture whose air-fuel ratio (the ratio between air and fuel) was first controlled to, for example, 19 was supplied to the engine, which was operated at 2000 rpm. The combustion pressure of the engine was monitored. When it was determined from the waveform of the combustion pressure that, of 1000 times of ignition, the number of times of misfire was less than 10 times (less than 1%), an air-fuel mixture whose air-fuel ratio was controlled to 19.5 was supplied to the engine, and the state of ignition was checked in the same manner. After that, the air-fuel ratio of the supplied air-fuel mixture was increased 0.5 at a time, and the air-fuel ratio at the time when the number of times of misfires (of 1000 times of ignition) became equal to or greater than 10 times (equal to or greater than 1%) was recorded as an ignition limit air-fuel ratio. Table 1 shows the respective ignition limit air-fuel ratios of the samples determined through the above-described procedure.

TABLE 1

| Sample | A (mm) | B (mm) | X (mm) | Y (mm) | V ($mm^3$) | Ignition limit air-fuel ratio | Air-fuel ratio increase percentage (%) |
|---|---|---|---|---|---|---|---|
| 1-1 | ϕ1.0 | | 2.0 | | 1.57 | 20.0 | — |
| 1-2 | ϕ2.0 | ϕ1.0 | 1.0 | 1.0 | 3.93 | 24.5 | 22.5 |
| 1-3 | ϕ1.0 | ϕ2.0 | | | | 19.5 | −2.5 |

As shown in Table 1, in the case of Sample 1-1 in which the inner diameter B of the constricted portion was made equal to the inner diameter A of the diameter-increased portion (B=A), the ignition limit air-fuel ratio was 20.0. In the case of Sample 1-2 in which the inner diameter B of the constricted portion was made smaller than the inner diameter A of the diameter-increased portion (B<A), the ignition limit air-fuel ratio was 24.5, which was 22.5% higher than the ignition limit air-fuel ratio of Sample 1-1. Meanwhile, in the case of Sample 1-3 in which the inner diameter B of the constricted portion was made larger than the inner diameter A of the diameter-increased portion (B>A), the ignition limit air-fuel ratio was 19.5, which was 2.5% lower than the ignition limit air-fuel ratio of Sample 1-1. Accordingly, it was found that the igniting performance of the plasma jet ignition plug can be improved by making the inner diameter B of the constricted portion of the cavity smaller than the inner diameter A of the diameter-increased portion.

Example 2

Next, there was carried out an evaluation test for checking the influence of the volume V of the cavity on the igniting performance. For this evaluation test, there were prepared three insulators having different cavity volumes V; i.e., insulators which were made different from one another only in the inner diameter A of the diameter-increased portion, but were the same in the inner diameter B of the constricted portion, the length X of the diameter-increased portion and the length Y of the constricted portion. Samples (plasma jet ignition plugs) 2-1 to 2-3 were made by use of these insulators. Specifically, in Samples 2-1 to 2-3, the inner diameter A of the diameter-increased portion was set to ϕ3.5 mm, ϕ0.75 mm, and ϕ4.0 mm, respectively. In all the samples, the inner diameter B of the constricted portion was set to ϕ0.5 mm, the length X of the diameter-increased portion was set to 1.5 mm, and the length Y of the constricted portion was set to 1.5 mm. Further, a ground electrode whose thickness Z was 1.0 mm and in which the inner diameter C of the communication hole was ϕ2.0 mm was used in each sample. An evaluation test similar to that employed in Example 1 was performed for each sample, and the ignition limit air-fuel ratio of each sample was determined. Table 2 shows the results of this test.

TABLE 2

| Sample | A (mm) | B (mm) | X (mm) | Y (mm) | V ($mm^3$) | Ignition limit air-fuel ratio | Air-fuel ratio increase percentage (%) |
|---|---|---|---|---|---|---|---|
| 2-1 | ϕ3.5 | ϕ0.5 | 1.5 | 1.5 | 14.72 | 24.0 | 20.0 |
| 2-2 | ϕ3.75 | | | | 16.85 | 21.0 | 5.0 |
| 2-3 | ϕ4.0 | | | | 19.13 | 20.5 | 2.5 |

As shown in Table 2, in the case of Sample 2-1 whose cavity volume V was 14.72 $mm^3$, the ignition limit air-fuel ratio was 24.0, which showed an improvement of 20.0% as compared with the ignition limit air-fuel ratio of Sample 1-1 (see Table 1). However, in the case of Samples 2-2 and 2-3 whose cavity volumes V were 16.85 $mm^3$ and 19.13 $mm^3$, respectively, their ignition limit air-fuel ratios were 21.0 and 20.5, respectively, which showed improvements of 5.0% and 2.5%, respective, as compared with the ignition limit air-fuel ratio of Sample 1-1. Accordingly, it was found that the greater the cavity volume V, the lower the ignition limit air-fuel ratio. From the results of this test, it was found that the cavity volume V is desirably made less than 15 $mm^3$ in order to improve the igniting performance of the plasma jet ignition plug.

Example 3

Next, there was performed an evaluation test for checking the influence, on the igniting performance, of the relation between the length X of the diameter-increased portion and the length Y of the constricted portion. In this evaluation test, Samples (plasma jet ignition plugs) 3-1 to 3-3 were made by use of three insulators in which the inner diameter A of the diameter-increased portion was set to ϕ2.0 mm, the inner diameter B of the constricted portion was set to ϕ1.0 mm, and the length X of the diameter-increased portion and the length Y of the constricted portion were made different from one another. Specifically, in Sample 3-1, both the length X of the diameter-increased portion and the length Y of the constricted portion were set to 1.5 mm. In Sample 3-2, X was set to 2.0 mm, and Y was set to 1.0 mm. In Sample 3-3, X was set to 1.0 mm, and Y was set to 2.0 mm. A ground electrode whose thickness Z was 1.5 mm and in which the inner diameter C of the communication hole was ϕ2.0 mm was commonly used in each sample. Notably, the cavity volume V of each sample was less than 15 $mm^3$. An evaluation test similar to that employed in Example 1 was performed for each sample, and the ignition limit air-fuel ratio of each sample was determined. Table 3 shows the results of this test.

TABLE 3

| Sample | A (mm) | B (mm) | X (mm) | Y (mm) | Z (mm) | V ($mm^3$) | Ignition limit air-fuel ratio | Air-fuel ratio increase percentage (%) |
|---|---|---|---|---|---|---|---|---|
| 3-1 | ϕ2.0 | ϕ1.0 | 1.5 | 1.5 | 1.5 | 5.89 | 24.0 | 20.0 |
| 3-2 | | | 2.0 | 1.0 | | 7.07 | 21.0 | 5.0 |
| 3-3 | | | 1.0 | 2.0 | | 4.71 | 24.0 | 20.0 |

As shown in Table 3, Samples 3-1 to 3-3 were made such that the ratio between the length X of the diameter-increased portion and the length Y of the constricted portion was changed while the sum (X+Y) of the lengths X and Y was maintained at 3.0 mm. In the case of Sample 3-1 in which the length X of the diameter-increased portion and the length Y of the constricted portion were made equal to each other (X=Y), the ignition limit air-fuel ratio was 24.0, which showed an improvement of 20.0% as compared with the ignition limit air-fuel ratio of Sample 1-1 (see Table 1). Also, in the case of Sample 3-3 in which the length X of the diameter-increased portion was made smaller than the length Y of the constricted portion (X<Y), the ignition limit air-fuel ratio was 24.0. However, in the case of Sample 3-2 in which the length X of the diameter-increased portion was made larger than the length Y of the constricted portion (X>Y), the ignition limit air-fuel ratio was 21.0, which showed an improvement of only 5.0% as compared with the ignition limit air-fuel ratio of Sample 1-1. Accordingly, it was found that the igniting performance of the plasma jet ignition plug can be improved further by making the length X of the diameter-increased portion equal to or less than the length Y of the constricted portion.

Example 4

Next, there was performed an evaluation test for checking the influence of the inner diameter A of the diameter-increased portion on the igniting performance. In this evaluation test, Samples (plasma jet ignition plugs) 4-1 and 4-2 were made by use of two insulators which were the same in the inner diameter B of the constricted portion, the length X of the diameter-increased portion, and the length Y of the constricted portion, but differed from each other in the inner diameter A of the diameter-increased portion. Specifically, in Samples 4-1 and 4-2, the inner diameter A of the diameter-increased portion was set to ϕ4.0 mm and ϕ4.5 mm, respectively. Further, in both Samples 4-1, 4-2, the inner diameter B of the constricted portion was set to ϕ0.5 mm, the length X of the diameter-increased portion was set to 0.5 mm, and the length Y of the constricted portion was set to 2.5 mm. Notably, in both the samples, the cavity volume V was set to be less than 15 $mm^3$. In both the samples, a ground electrode whose thickness Z was 1.0 mm and in which the inner diameter C of the communication hole was ϕ2.0 mm was used. An evaluation test similar to that employed in Example 1 was performed for both the samples, and the ignition limit air-fuel ratio of each sample was determined. Table 4 shows the results of this test.

TABLE 4

| Sample | A (mm) | B (mm) | X (mm) | Y (mm) | V ($mm^3$) | Ignition limit air-fuel ratio | Air-fuel ratio increase percentage (%) |
|---|---|---|---|---|---|---|---|
| 4-1 | ϕ4.0 | ϕ0.5 | 0.5 | 2.5 | 6.77 | 24.5 | 22.5 |
| 4-2 | ϕ4.5 | | | | 8.44 | 20.0 | 0 |

As shown in Table 4, in the case of Sample 4-1 in which the inner diameter A of the diameter-increased portion was set to ϕ4.0 mm, the ignition limit air-fuel ratio was ϕ4.5, which showed an improvement of 22.5% as compared with the ignition limit air-fuel ratio of Sample 1-1 (see Table 1). However, in the case of Sample 4-2 in which the inner diameter A of the diameter-increased portion was set to ϕ4.5 mm, the ignition limit air-fuel ratio was 20.0, which was equal to the ignition limit air-fuel ratio of Sample 1-1. Accordingly, it is found that the inner diameter A of the diameter-increased portion is desirably set to ϕ4.0 mm or less so as to improve the igniting performance of the plasma jet ignition plug.

Example 5

Next, there was performed an evaluation test for checking the influence of the inner diameter B of the constricted portion on the igniting performance. In this evaluation test, Samples (plasma jet ignition plugs) 5-1 to 5-4 were made by use of four insulators which were the same in the inner diameter A of the diameter-increased portion, the length X of the diameter-increased portion, and the length Y of the constricted portion, but differed from one another in the inner diameter B of the constricted portion. Specifically, in Samples 5-1 to 5-4, the inner diameter B of the constricted portion was set to ϕ0.3 mm, ϕ0.5 mm, ϕ1.5 mm, and ϕ1.8 mm, respectively. Further, in all Samples 5-1 to 5-4, the inner diameter A of the diameter-increased portion was set to ϕ2.0 mm, the length X of the diameter-increased portion was set to 1.0 mm, and the length Y of the constricted portion was set to 1.0 mm. Notably, in each sample, the cavity volume V was set to be less than 15 $mm^3$. A ground electrode whose thickness Z was 1.0 mm and in which the inner diameter C of the communication hole was ϕ2.0 mm was used in each sample. An evaluation test similar to that employed in Example 1 was performed for each sample, and the ignition limit air-fuel ratio of each sample was determined. Table 5 shows the results of this test.

TABLE 5

| Sample | A (mm) | B (mm) | X (mm) | Y (mm) | V ($mm^3$) | Ignition limit air-fuel ratio | Air-fuel ratio increase percentage (%) |
|---|---|---|---|---|---|---|---|
| 5-1 | ϕ2.0 | ϕ0.3 | 1.0 | 1.0 | 3.21 | 20.5 | 2.5 |
| 5-2 | | ϕ0.5 | | | 3.34 | 24.5 | 22.5 |
| 5-3 | | ϕ1.5 | | | 4.91 | 24.0 | 20.0 |
| 5-4 | | ϕ1.8 | | | 5.68 | 21.0 | 5.0 |

As shown in Table 5, the respective ignition limit air-fuel ratios of Samples 5-2 and 5-3 in which the inner diameter B of the constricted portion was set to ϕ0.5 mm and ϕ1.5 mm, respectively, were 24.5 and 24.0, which showed improvements of 22.5% and 20.0%, respectively, as compared with the ignition limit air-fuel ratio of Sample 1-1 (see Table 1). However, in the case of Sample 5-1 in which the inner diameter B of the constricted portion was made smaller than ϕ0.5 mm; i.e., set to ϕ0.3 mm, the ignition limit air-fuel ratio was 20.5, which showed an improvement of only 2.5% as compared with the ignition limit air-fuel ratio of Sample 1-1. Further, in the case of Sample 5-4 in which the inner diameter B of the constricted portion was made larger than ϕ1.5 mm; i.e., set to ϕ1.8 mm, the ignition limit air-fuel ratio was 21.0, which showed an improvement of only 5.0% as compared with the ignition limit air-fuel ratio of Sample 1-1. Accordingly, it is found that the inner diameter B of the constricted portion is desirably set to be not smaller than ϕ0.5 mm but not larger than ϕ1.5 mm.

Example 6

Next, there was performed an evaluation test for checking the influence of the sum of the length X of the diameter-increased portion and the length Y of the constricted portion on the igniting performance. In this evaluation test, Samples (plasma jet ignition plugs) 6-1 to 6-5 were made by use of five insulators in which the inner diameter A of the diameter-increased portion was set to ϕ2.0 mm, the inner diameter B of the constricted portion was set to ϕ1.0 mm, and the length X of the diameter-increased portion and the length Y of the constricted portion were made different from one another. Specifically, in Samples 6-1 to 6-5, the length X of the diameter-increased portion and the length Y of the constricted portion were combined as follows. In Sample 6-1, X was set to 1.5 mm, and Y was set to 2.0 mm. In Sample 6-2, both X and Y were set to 2.0 mm. In Sample 6-3, both X and Y were set to 1.0 mm. In Samples 6-4 and 6-5, both X and Y were set to 0.5 mm. Further, a ground electrode whose thickness Z was 1.5 mm and in which the inner diameter C of the communication hole was ϕ2.0 mm was used in Samples 6-1 to 6-3, and a similar ground electrode whose thickness Z was set to 1.0 mm and a similar ground electrode whose thickness Z was set to 0.8 mm were used in Samples 6-4 and 6-5. Notably, the cavity volume V was set to be less than 15 $mm^3$ in each sample. An evaluation test similar to that employed in Example 1 was performed for each sample, and the ignition limit air-fuel ratio of each sample was determined. Table 6 shows the results of this test. In Table 6, Samples 3-1 and 3-3 (see Table 3) and Sample 1-2 (see Table 1) are also listed.

TABLE 6

| Sample | A (mm) | B (mm) | X (mm) | Y (mm) | Z (mm) | V ($mm^3$) | Ignition limit air-fuel ratio | Air-fuel ratio increase percentage (%) |
|---|---|---|---|---|---|---|---|---|
| 6-1 | ϕ2.0 | ϕ1.0 | 1.5 | 2.0 | 1.5 | 6.28 | 21.0 | 5.0 |
| 6-2 | | | 2.0 | | | 7.85 | 20.0 | 0 |
| 6-3 | | | 1.0 | 1.0 | | 3.93 | 23.5 | 17.5 |
| 6-4 | | | 0.5 | 0.5 | 1.0 | 1.96 | 20.5 | 2.5 |
| 6-5 | | | | | 0.8 | | 23.0 | 15.0 |
| 3-1 | ϕ2.0 | ϕ1.0 | 1.5 | 1.5 | 1.5 | 5.89 | 24.0 | 20.0 |
| 3-3 | | | 1.0 | 2.0 | | 4.71 | 24.0 | 20.0 |
| 1-2 | | | | 1.0 | 1.0 | 3.93 | 24.5 | 22.5 |

As shown in Table 6, in Sample 6-1 to 6-3, the value of X+Y was changed, while the relation X≦Y was satisfied. In the case of Sample 6-3 in which the relation X=Y was satisfied and the value of X+Y was set to 2.0 mm, the ignition limit air-fuel ratio was 23.5, which showed an improvement of 17.5% as compared with the ignition limit air-fuel ratio of Sample 1-1 (see Table 1). Meanwhile, in the case of Sample 6-2 in which the value of X+Y was set to 4.0 mm, the ignition limit air-fuel ratio was 20.0, and no improvement was observed as compared with the ignition limit air-fuel ratio of Sample 1-1. Through comparison between Samples 6-2, 6-3 and Sample 3-1 (X+Y=3.0 mm), it is found that, when the value of X+Y is increased excessively, the ignition limit air-fuel ratio decreases. Further, in the case of Sample 6-1 in which the relation X<Y was satisfied and the value of X+Y was set to 3.5 mm, the ignition limit air-fuel ratio was 21.0, which showed an improvement of only 5.0% as compared with the ignition limit air-fuel ratio of Sample 1-1. Through comparison between Sample 6-1 and Sample 3-3, it is also found that, when the value of X+Y is increased excessively, the ignition limit air-fuel ratio decreases. From these, it was found that, when the value of X+Y is set to equal to or less than 3.0 mm, the igniting performance of the plasma jet ignition plug can be improved.

Notably, although Sample 6-3 and Sample 1-2 (see Table 1) are the same in the sizes of the diameter-increased portion and the constricted portion, they differ from each other in the thickness Z of the ground electrode. Specifically, in Sample 6-3, Z was set to 1.5 mm, and, in Sample 1-2, Z was set to 1.0 mm. Through comparison between the igniting performances of both the samples, it is found that both the samples exhibited a satisfactory igniting performance, although the ignition limit air-fuel ratio of Sample 6-3 was slightly lower than that of Sample 1-2. Although both the samples satisfy the relation Z<X+Y, the igniting performance tends to lower when the value of Z increases relative to the value of X+Y. Further, in the case of Sample 6-4 in which the value of X+Y was set to 1.0 mm and Z was set to 1.0 mm (Z=X+Y), the ignition limit air-fuel ratio was 20.5, which showed an improvement of only 2.5% as compared with the ignition limit air-fuel ratio of Sample 1-1. However, in the case of Sample 6-5 in which the sizes of the diameter-increased portion and the constricted portion were maintained the same as those in Sample 6-4 but the value of Z was decreased to 0.8 mm (Z<X+Y), the ignition limit air-fuel ratio became 23.0, which showed an improvement of 15.0% as compared with the ignition limit air-fuel ratio of Sample 1-1. From these, it was found that, when the relation Z<X+Y is satisfied, the igniting performance of the plasma jet ignition plug is improved.

Example 7

Next, there was performed an evaluation test for checking the influence of the relation between the length X and inner diameter A of the diameter-increased portion on the igniting performance. In this evaluation test, Samples (plasma jet ignition plugs) 7-1 to 7-3 were made by use of three insulators in which the length X of the diameter-increased portion and the length Y of the constricted portion were made different from one other such that the value of X+Y became 3.0 mm, while the inner diameter A of the diameter-increased portion and the inner diameter B of the constricted portion were maintained constant. Specifically, in each of Samples 7-1 to 7-3, the inner diameter A of the diameter-increased portion was set to ϕ1.0 mm and the inner diameter B of the constricted portion was set to ϕ0.5 mm. Also, in Sample 7-1, X was set to 0.5 mm, and Y was set to 2.5 mm; and, in Sample 7-2, X was set to 1.0 mm, and Y was set to 2.0 mm. Further, in Sample 7-3, X was set to 1.25 mm, and Y was set to 1.75 mm. Notably, a ground electrode whose thickness Z was 1.0 min and in which the inner diameter C of the communication hole was ϕ2.0 mm was used in each sample. An evaluation test similar to that employed in Example 1 was performed for each sample, and the ignition limit air-fuel ratio of each sample was determined. Table 7 shows the results of this test.

TABLE 7

| Sample | A (mm) | B (mm) | X (mm) | Y (mm) | V ($mm^3$) | Ignition limit air-fuel ratio | Air-fuel ratio increase percentage (%) |
|---|---|---|---|---|---|---|---|
| 7-1 | ϕ1.0 | ϕ0.5 | 0.5 | 2.5 | 0.88 | 24.5 | 22.5 |
| 7-2 | | | 1.0 | 2.0 | 1.18 | 24.0 | 20.0 |
| 7-3 | | | 1.25 | 1.75 | 1.32 | 21.5 | 7.5 |

As shown in Table 7, in the case of Sample 7-1 which satisfied the relation X<A and Sample 7-2 which satisfied the relation X=A, their ignition limit air-fuel ratios were 24.5 and 24.0, respectively, which showed improvements of 22.5% and 20.0%, respectively, as compared with the ignition limit air-fuel ratio of Sample 1-1 (see Table 1). However, in the case of Sample 7-3 in which X>A, the ignition limit air-fuel ratio was 21.5, which showed an improvement of only 7.5% as compared with the ignition limit air-fuel ratio of Sample 1-1. From this, it was found that, when the relation X≦A is satisfied, the igniting performance of the plasma jet ignition plug is improved.

Example 8

Next, there was performed an evaluation test for checking the influence of the inner diameter C of the communication hole on the igniting performance. In this evaluation test, there were prepared three Samples (plasma jet ignition plugs) 8-1 to 8-3 which were identical with one another in the size of the cavity (the same cavity as that of Sample 3-3 (see Table 3); i.e., the inner diameter A of the diameter-increased portion was set to ϕ2.0 mm, the length X of the diameter-increased portion was set to 1.0 mm, the inner diameter B of the constricted portion was set to ϕ1.0 mm, and the length Y of the constricted portion was set to 2.0 mm), and which differed from one another in the inner diameter C of the communication hole of the ground electrode. In Samples 8-1, 8-2, and 8-3, the inner diameter C of the communication hole of the ground electrode was set to ϕ0.5 mm, ϕ1.0 mm, and ϕ1.5 mm, respectively. Notably, in all the samples, the thickness Z of the ground electrode was set to 1.0 mm. An evaluation test similar to that employed in Example 1 was performed for each sample, and the ignition limit air-fuel ratio of each sample was determined. Table 8 shows the results of this test.

TABLE 8

| Sample | A (mm) | B (mm) | C (mm) | X (mm) | Y (mm) | Z (mm) | V ($mm^3$) | Ignition limit air-fuel ratio | Air-fuel ratio increase percentage (%) |
|---|---|---|---|---|---|---|---|---|---|
| 8-1 | ϕ2.0 | ϕ1.0 | ϕ0.5 | 1.0 | 2.0 | 1.0 | 4.71 | 20.5 | 2.5 |
| 8-2 | | | ϕ1.0 | | | | | 24.0 | 20.0 |
| 8-3 | | | ϕ1.5 | | | | | 25.0 | 25.0 |

As shown in Table 8, in the case of Sample 8-1 in which B>C, the ignition limit air-fuel ratio was 20.5, which showed an improvement of only 2.5% as compared with the ignition limit air-fuel ratio of Sample 1-1 (see Table 1). However, in the case of Sample 8-2 in which B=C and Sample 8-3 in which B<C, their ignition limit air-fuel ratios were 24.0 and 25.0, respectively, which showed improvements of 20.0% and 25.0%, respectively, as compared with the ignition limit air-fuel ratio of Sample 1-1. From this, it was found that, when the relation B≦C is satisfied, the igniting performance of the plasma jet ignition plug is improved.

Example 9

Next, there was performed an evaluation test for checking the influence, on the igniting performance, of the difference between the outer diameter of the front end portion of the center electrode and the inner diameter of the constricted portion. In this evaluation test, there were prepared four Samples (plasma jet ignition plugs) 9-1 to 9-4 which used an insulator formed such that the inner diameter A of the diameter-increased portion was ϕ2.0 mm, the length X of the diameter-increased portion was 1.0 mm, the inner diameter B of the constricted portion was ϕ1.0 mm, and the length Y of the constricted portion was 1.0 mm, and in which the outer diameter D of the front end portion of the center electrode was made different from one another with a range of 0.6 mm to 1.2 mm. Further, there were prepared three Samples (plasma jet ignition plugs) 9-5 to 9-7 which used an insulator formed such that the inner diameter A of the diameter-increased portion was ϕ3.0 mm, the length X of the diameter-increased portion was 1.0 mm, the inner diameter B of the constricted portion was ϕ0.5 mm, and the length Y of the constricted portion was 1.0 mm, and in which the outer diameter D of the front end portion of the center electrode was made different from one another with a range of 2.2 mm to 2.6 mm. Notably, in each sample, the inner diameter C of the communication hole of the ground electrode was ϕ1.0 mm, and the thickness Z of the ground electrode was 1.0 mm.

An evaluation test similar to that employed in Example 1 was performed for each sample, and the ignition limit air-fuel ratio of each sample was determined. Further, an ignition test was performed for each sample for 30 hours. In the evaluation test, each sample was caused to generate spark 60 times per second within a chamber pressurized to 0.6 MPa. Each sample was then disassembled after the ignition test, and the depth of a groove formed on the insulator as a result of generation of channeling was measured by use of a three-dimensional laser measurement device. A sample in which the depth of a groove formed as a result of channeling was less than 0.2 mm was evaluated "Good." A sample in which the depth of a groove formed as a result of channeling fell within a range of 0.2 mm to 0.4 mm was evaluated "Fair," because the generated channeling was minor and no problem will arise during use. Meanwhile, a sample in which the depth of a groove formed as a result of channeling was equal to or greater than 0.4 mm was evaluated "Bad," because a problem will arise during use. Table 9 shows the results of this test.

TABLE 9

| Sample | A (mm) | B (mm) | C (mm) | D (mm) | X (mm) | Y (mm) | Z (mm) | V ($mm^3$) | D-B (mm) | Ignition limit air-fuel ratio | Air-fuel ratio increase percentage (%) | Degree of channeling |
|---|---|---|---|---|---|---|---|---|---|---|---|---|
| 9-1 | ϕ2.0 | ϕ1.0 | ϕ1.0 | ϕ0.6 | 1.0 | 1.0 | 1.0 | 3.93 | −0.4 | 22.0 | 10.0 | Good |
| 9-2 | | | | ϕ0.8 | | | | | −0.2 | 22.5 | 12.5 | Good |
| 9-3 | | | | ϕ1.0 | | | | | 0 | 24.0 | 20.0 | Good |
| 9-4 | | | | ϕ1.2 | | | | | 0.2 | 24.5 | 22.5 | Good |
| 9-5 | ϕ3.0 | ϕ0.5 | | ϕ2.2 | | | | 7.26 | 1.7 | 24.0 | 20.0 | Fair |
| 9-6 | | | | ϕ2.5 | | | | | 2.0 | 24.0 | 20.0 | Fair |
| 9-7 | | | | ϕ2.6 | | | | | 2.1 | 24.0 | 20.0 | Bad |

As shown in Table 9, in the case of Samples 9-3 to 9-7 in which the value of D−B was equal to or greater than 0, the ignition limit air-fuel ratio was equal to or greater than 24, which showed an improvement of 20.0% or more as compared with the ignition limit air-fuel ratio of Sample 1-1 (see Table 1). However, in the case of Samples 9-1 and 9-2 in which the value of D−B was less than 0, the ignition limit air-fuel ratio was equal to or less than 22.5, which showed an improvement of only 10.0% to 12.5%. Meanwhile, there was observed a tendency that, as the value of D−B increased, the depth of the groove formed as a result of channeling increased. In particular, in the case of Sample 9-7 in which value of D−B was greater than 2.0, its channeling was evaluated "Bad," and that value of D−B was not preferable from the view point of durability of the plasma jet ignition plug. From this, it was found that, the value of D−B which satisfies the relation $0 \leqq D-B \leqq 2$ mm improves the igniting performance of the plasma jet ignition plug and is preferable from the view point of durability.

Example 10

Next, there was performed an evaluation test for checking the influence, on the igniting performance, of the ratio of the cross sectional area of the constricted portion to the volume of the cavity. In this test, Sample (plasma jet ignition plug) 10-1 was made by use of an insulator formed such that the inner diameter A of the diameter-increased portion was ϕ4.0 mm, the length X of the diameter-increased portion was 2.0 mm, the inner diameter B of the constricted portion was ϕ0.5 mm, and the length Y of the constricted portion was 1.0 mm. A ground electrode whose thickness Z was 1.5 mm and in which the inner diameter C of the communication hole was set to ϕ1.0 mm was assembled to Sample 10-1. The S/V ratio of Sample 10-1 was 0.008. Further, the S/V ratios of the samples (plasma jet ignition plugs) made in other evaluation tests were obtained from the data of the samples. Samples whose S/V ratios differed from one another within a range of 0.010 to 0.448 were selected, and the igniting performances of the selected samples were compared with that of Sample 10-1. Table 10 shows the results of this test.

TABLE 10

| Sample | A (mm) | B (mm) | C (mm) | D (mm) | X (mm) | Y (mm) | Z (mm) | V ($mm^3$) | S ($mm^2$) | S/V | Ignition limit air-fuel ratio | Air-fuel ratio increase percentage (%) |
|---|---|---|---|---|---|---|---|---|---|---|---|---|
| 10-1 | ϕ4.0 | ϕ0.5 | ϕ1.0 | ϕ1.5 | 2.0 | 1.0 | 1.5 | 25.33 | 0.20 | 0.008 | 20.5 | 2.5 |
| 2-3 | | | | | 1.5 | 1.5 | | 19.14 | | 0.010 | 20.5 | 2.5 |
| 2-1 | ϕ3.5 | | | | | | | 14.73 | | 0.013 | 24.0 | 20.0 |

TABLE 10-continued

| Sample | A (mm) | B (mm) | C (mm) | D (mm) | X (mm) | Y (mm) | Z (mm) | V ($mm^3$) | S ($mm^2$) | S/V | Ignition limit air-fuel ratio | Air-fuel ratio increase percentage (%) |
|---|---|---|---|---|---|---|---|---|---|---|---|---|
| 6-3 | ϕ2.0 | ϕ1.0 | | | 1.0 | 1.0 | | 3.93 | 0.79 | 0.200 | 23.5 | 17.5 |
| 4-1 | ϕ4.0 | ϕ0.5 | | | 0.5 | 2.5 | | 6.77 | 0.20 | 0.029 | 24.5 | 22.5 |
| 6-5 | ϕ2.0 | ϕ1.0 | | | | 0.5 | 0.8 | 1.96 | 0.79 | 0.400 | 23.0 | 15.0 |
| 5-4 | | ϕ1.8 | | | 1.0 | 1.0 | 1.0 | 5.69 | 2.54 | 0.448 | 21.0 | 5.0 |

As shown in Table 10, in the case of Samples 10-1 and 2-3 in which the value of S/V was equal to or less than 0.01, the ignition limit air-fuel ratio was 20.5, which showed an improvement of only 2.5%. Further, in the case of Sample 5-4 in which the value of S/V was greater than 0.4, the ignition limit air-fuel ratio was 21.0, which showed an improvement of only 5.0%. However, in the case of Samples 2-1, 6-3, 4-1, and 6-5 in which the value of S/V was greater than 0.01 but not greater than 0.4, the ignition limit air-fuel ratio was approximately 23.0 or higher, and an air-fuel ratio increase percentage of 15.0% or greater was attained. From this, it was found that, when $0.01<S/V\leqq 0.4$, the igniting performance of the plasma jet ignition plug is improved.

Example 11

Next, there was carried out an evaluation test for checking the influence, on the igniting performance, of the ratio of the amount of energy supplied from a power source to the volume of the cavity. In this evaluation test, Samples 6-1, 6-2, and 2-1 used in other evaluation tests were individually attached to a six-cylinder engine for testing, and were connected to an ignition apparatus. The ignition apparatus was configured such that, by means of properly replacing the capacitor of the plasma discharge circuit section, the amount of energy supplied for ignition of one time can be changed to one of six levels within a range of 30 to 300 mJ. An evaluation test similar to that employed in Example 1 was performed for each sample, and the ignition limit air-fuel ratio was determined for each amount of energy. Table 11 shows the results of this test. Also, the relation between E/V and air-fuel-ratio increase percentage is shown in the semilogarithimic graph of FIG. 11.

TABLE 11

| Sample | A (mm) | B (mm) | X (mm) | Y (mm) | V ($mm^3$) | E (mJ) | E/V | Ignition limit air-fuel ratio | Air-fuel ratio increase percentage (%) |
|---|---|---|---|---|---|---|---|---|---|
| 6-1 | ϕ1.0 | ϕ0.5 | 0.5 | 2.5 | 0.88 | 30 | 33.95 | 22.0 | 10.0 |
| | | | | | | 40 | 45.27 | 22.5 | 12.5 |
| | | | | | | 50 | 56.59 | 23.0 | 15.0 |
| | | | | | | 100 | 113.18 | 24.0 | 20.0 |
| | | | | | | 200 | 226.35 | 24.5 | 22.5 |
| | | | | | | 300 | 339.53 | 24.5 | 22.5 |
| 6-2 | ϕ1.0 | ϕ0.5 | 1.0 | 2.0 | 1.18 | 30 | 25.46 | 21.5 | 7.5 |
| | | | | | | 40 | 33.95 | 22.0 | 10.0 |
| | | | | | | 50 | 42.44 | 22.5 | 12.5 |
| | | | | | | 100 | 84.88 | 24.0 | 20.0 |
| | | | | | | 200 | 169.77 | 24.5 | 22.5 |
| | | | | | | 300 | 254.65 | 24.5 | 22.5 |
| 2-1 | ϕ3.5 | ϕ0.5 | 1.5 | 1.5 | 14.73 | 30 | 2.04 | 19.0 | −2.5 |
| | | | | | | 40 | 2.72 | 20.0 | 0 |
| | | | | | | 50 | 3.40 | 22.0 | 10.0 |
| | | | | | | 100 | 6.79 | 24.0 | 20.0 |
| | | | | | | 200 | 13.58 | 24.0 | 20.0 |
| | | | | | | 300 | 20.37 | 24.5 | 22.5 |

Figure 11:
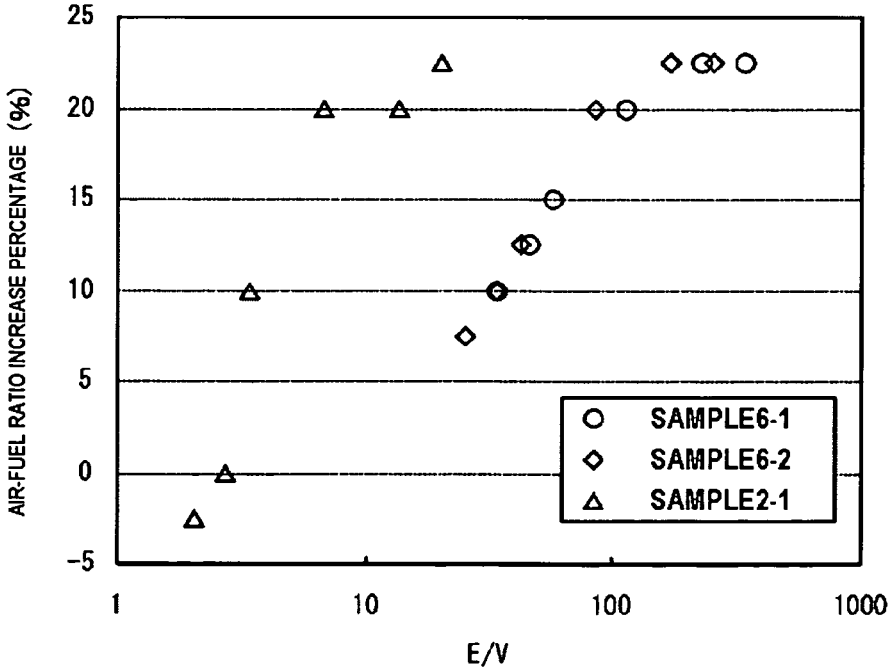
FIG. 11 is a semilogarithimic graph showing the relation between E/V and air-fuel-ratio increase percentage.

As shown in Table 11, Samples 6-1, 6-2, and 2-1 differ from one another in the volume V of the cavity. In each sample, the ignition limit air-fuel ratio increased with the amount of supplied energy E. As shown in FIG. 11, in the case of Samples 6-1 and 6-2, the air-fuel ratio increase percentage reached 20% when the value of E/V was about 100. It was found from the semilogarithimic graph of FIG. 11 that, when the value of E/V exceeds 200, the air-fuel ratio increase percentage assumes a generally constant value; i.e., a saturated value. The value of E/V is desirably set to 200 or less so as to suppress consumption of the electrode. Further, as shown in FIG. 11, in the case of Sample 2-1, when the value of E/V is greater than 3, the air-fuel ratio increase percentage becomes greater than 10%. From this, it was found that the value of E/V which satisfies the relation $3<E/V\leqq 200$ improves the igniting performance of the plasma jet ignition plug, and is also preferable from the view point of durability.

Figure 4:
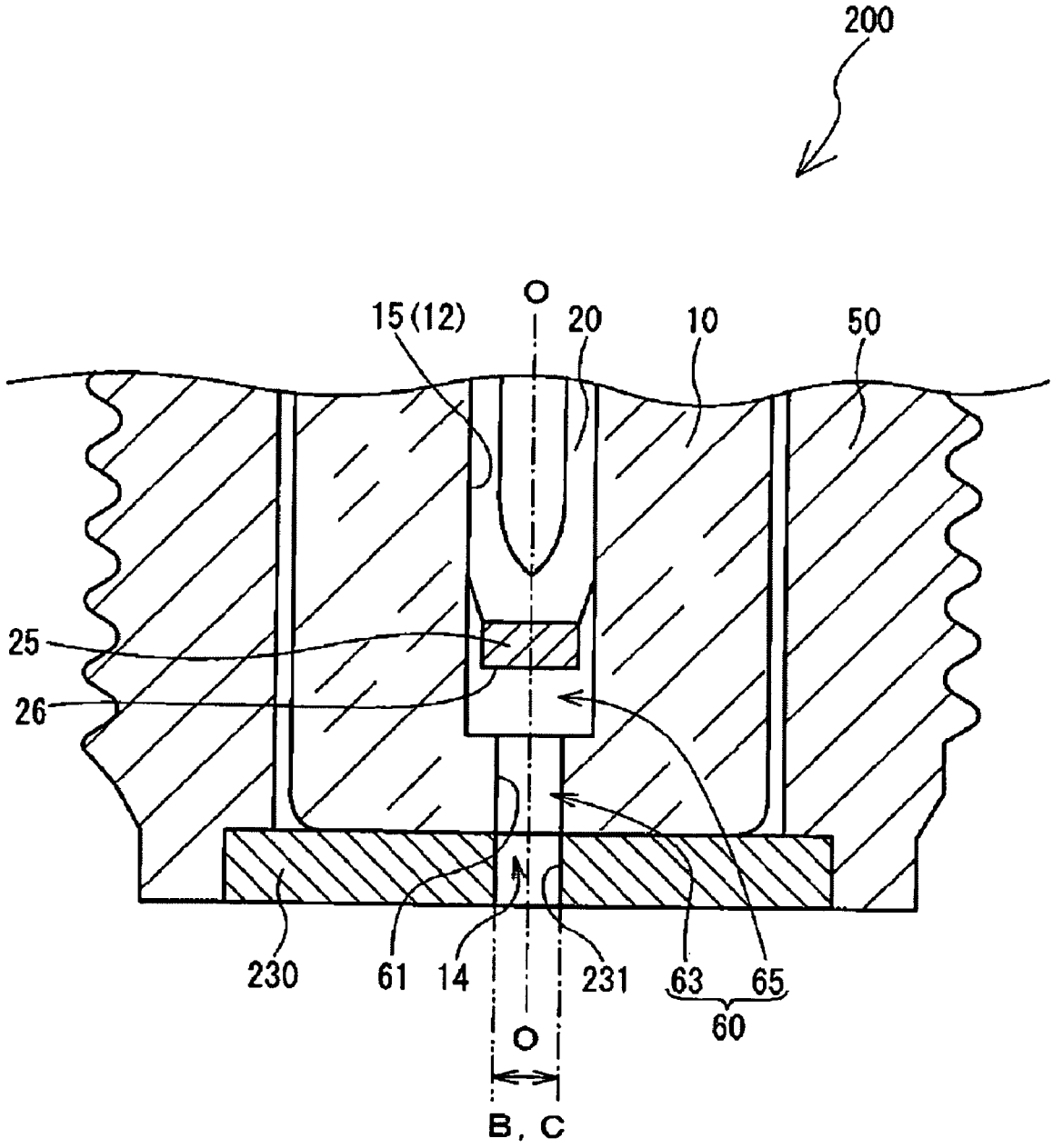
FIG. 4 is a partial sectional view of a plasma jet ignition plug 200 according to one modification.
Figure 5:
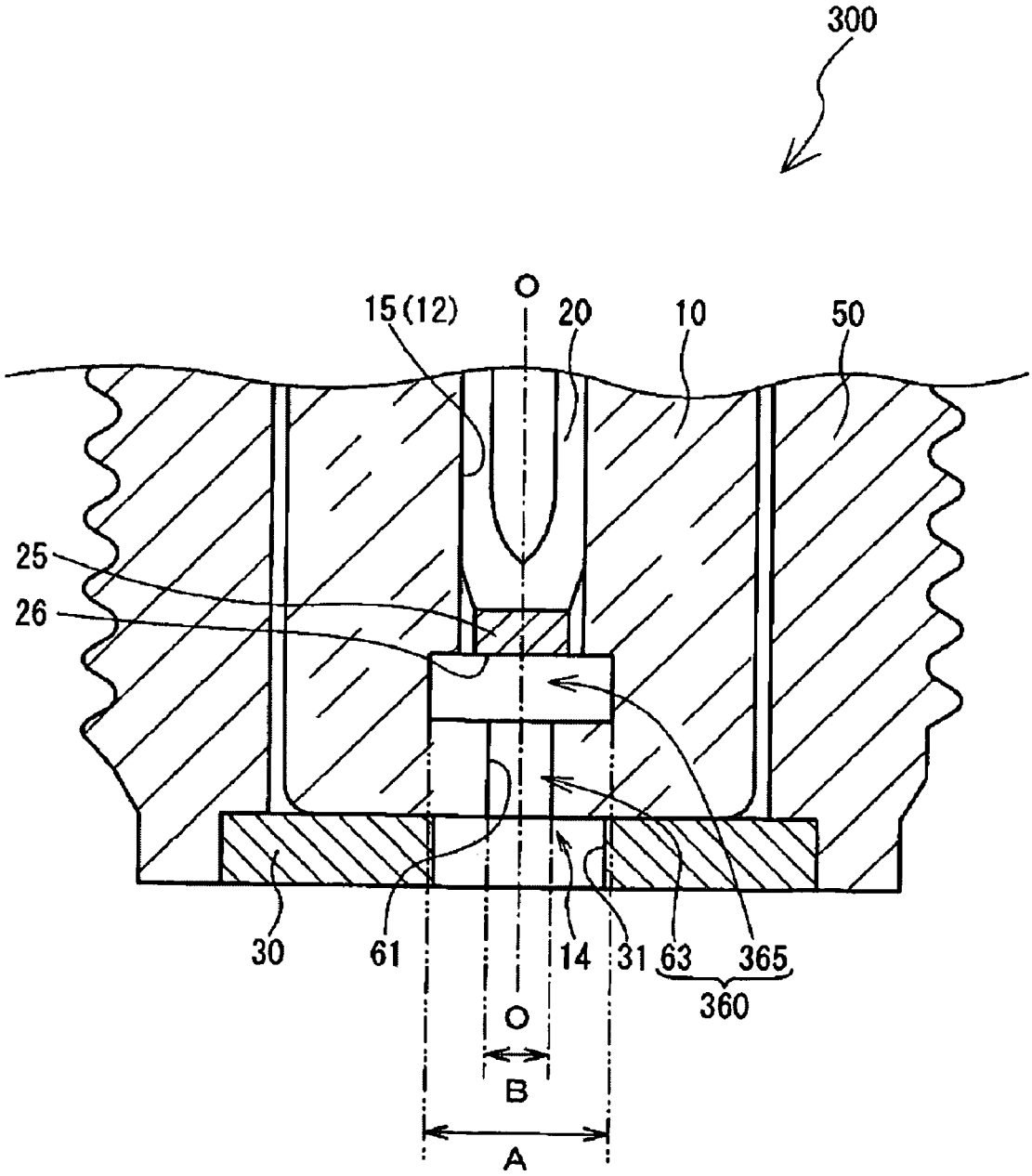
FIG. 5 is a partial sectional view of a plasma jet ignition plug 300 according to another modification.
Figure 6:
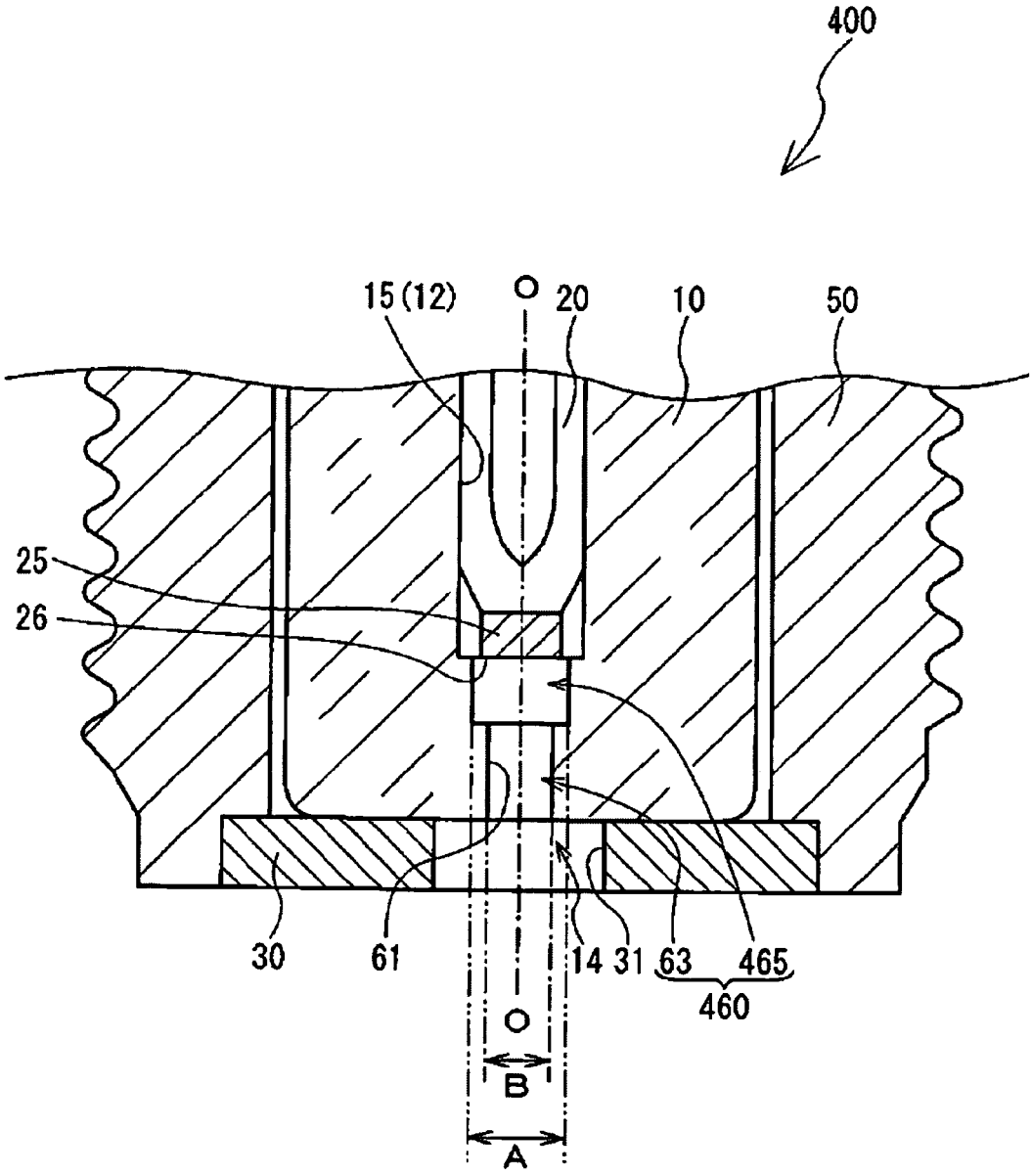
FIG. 6 is a partial sectional view of a plasma jet ignition plug 400 according to another modification.

Notably, needless to say, the present invention can be modified in various ways. For example, as in the case of a plasma jet ignition plug 200 shown in FIG. 4, the inner diameter C of a communication hole 231 of a ground electrode 230 may be equal to the inner diameter B of the constricted portion 63 of the cavity 60. Further, when the inner diameter A of the diameter-increased portion 65 of the cavity 60 is increased or decreased, the inner diameter of the electrode-accommodating portion 15 of the axial bore 12 and the inner diameter of the front-end small-diameter portion 61 (that is, the inner diameter B of the constricted portion 63) may be maintained unchanged. For example, as in the case of a plasma jet ignition plug 300 shown in FIG. 5, the inner diameter A of a diameter-increased portion 365 of a cavity 360 may be made larger than the inner diameter of the electrode-accommodating portion 15; i.e., the outer diameter of the center electrode 20. Alternatively, as in the case of a plasma jet ignition plug 400 shown in FIG. 6, the inner diameter A of a diameter-increased portion 465 of a cavity 460 may be made smaller than the inner diameter of the electrode-accommodating portion 15; i.e., the outer diameter of the center electrode 20. In this case, the inner diameters A and B are determined such that the relation B<A is satisfied.

Figure 7:
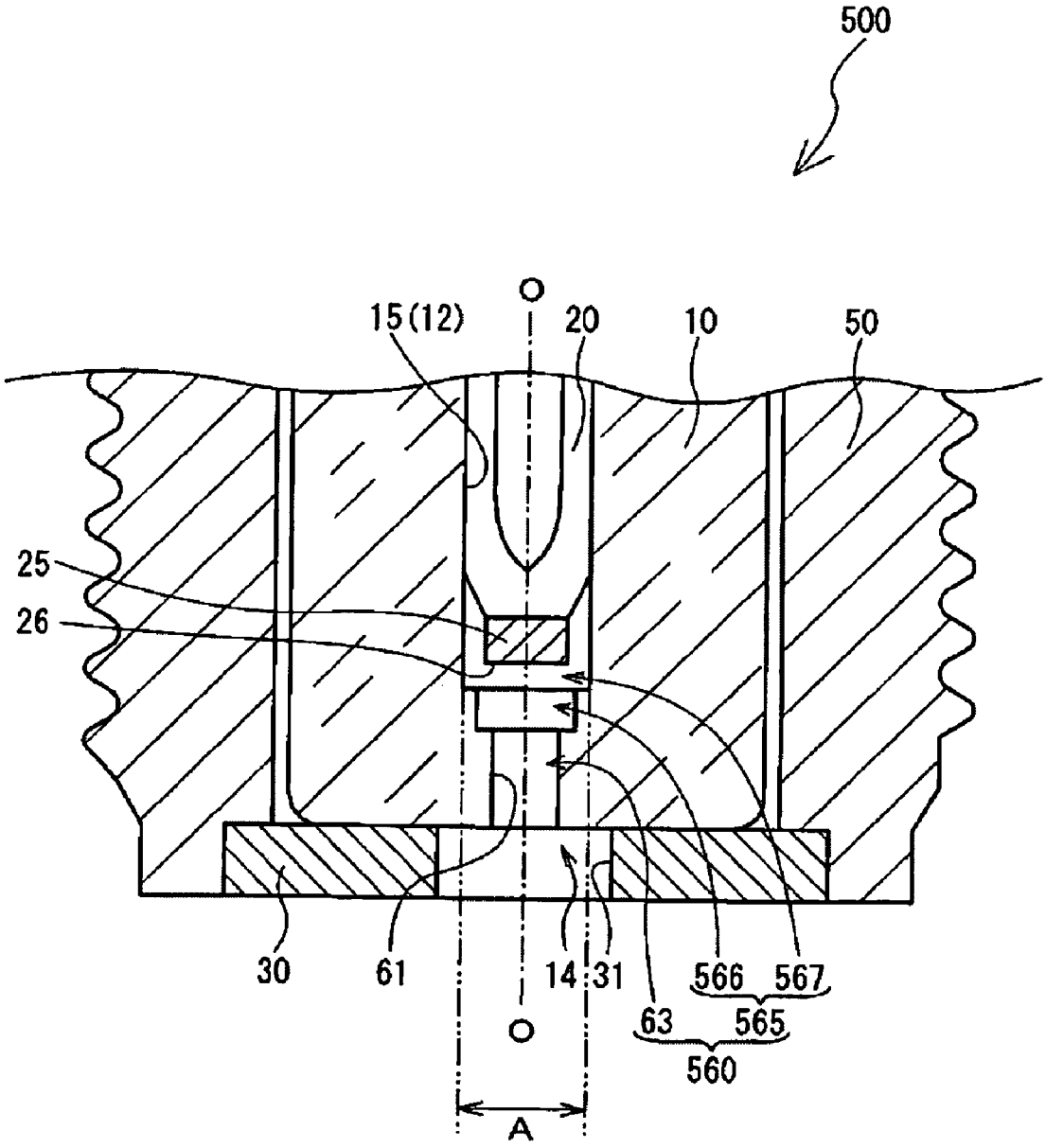
FIG. 7 is a partial sectional view of a plasma jet ignition plug 500 according to another modification.
Figure 8:
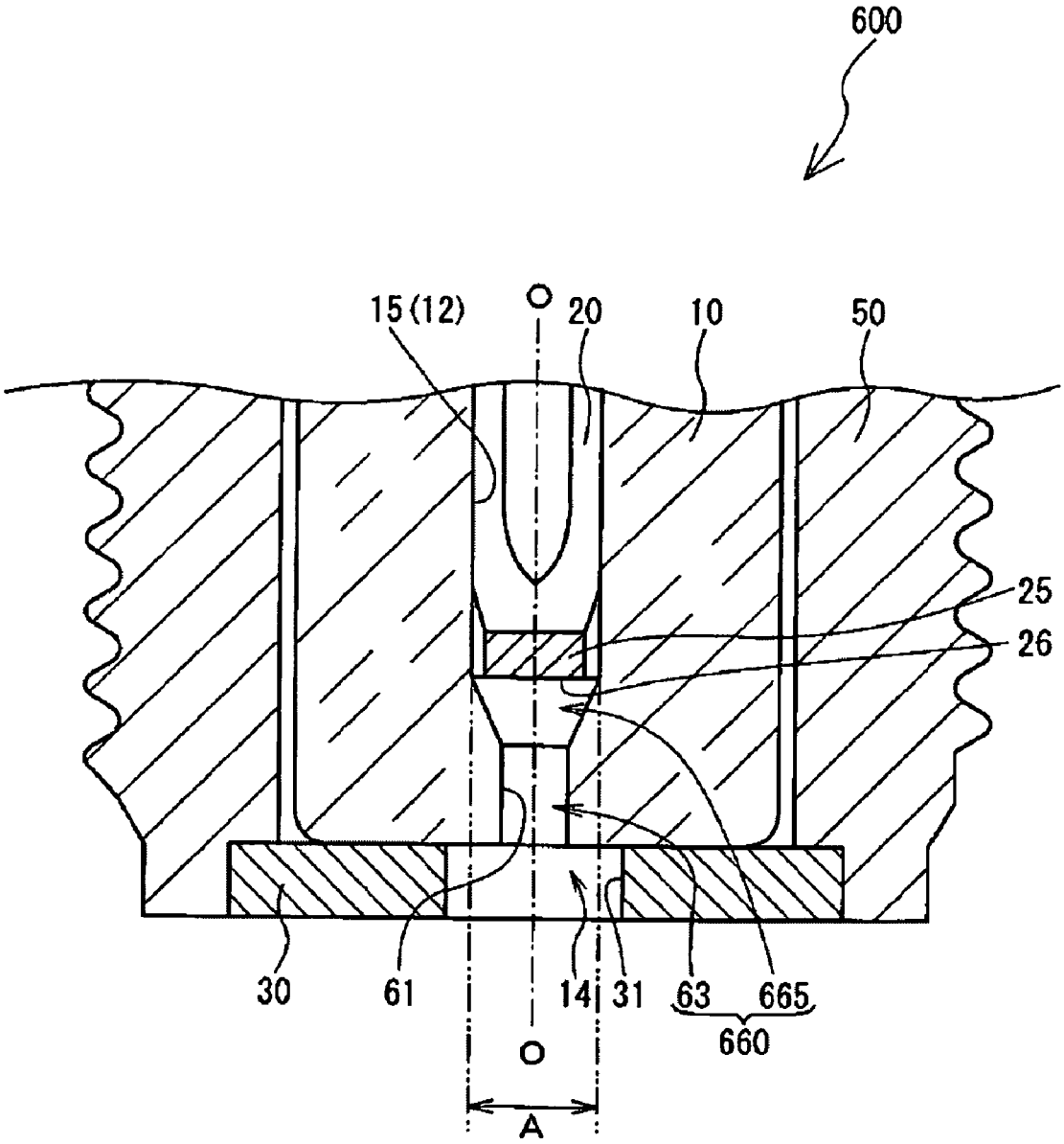
FIG. 8 is a partial sectional view of a plasma jet ignition plug 600 according to another modification.

Further, as in the case of a plasma jet ignition plug 500 as shown in FIG. 7, a diameter-increased portion 565 of a cavity 560 may be composed of two chambers of different diameters; i.e., a first diameter-increased portion 566 having a small diameter and a second diameter-increased portion 567 having a diameter greater than the diameter of the first diameter-increased portion 566. Of course, the cavity may be composed of three or more chambers of different diameters. Alternatively, as in the case of a diameter-increased portion 665 of a cavity 660 of a plasma jet ignition plug 600 shown in FIG. 8, the inner circumferential surface of the diameter-increased portion 665 may be tapered. In such a case, the inner diameter A of the diameter-increased portion is the inner diameter of a part of the diameter-increased portion which part has the largest inner diameter. For example, in the case of the plasma jet ignition plug 500 shown in FIG. 7, the diameter of the second diameter-increased portion 567 is used as the inner diameter A of the diameter-increased portion. Similarly, in the case of the plasma jet ignition plug 600 shown in FIG. 8, the diameter of the most expanded portion of the tapered inner circumferential surface (in the case of FIG. 8, a portion connected to the electrode-accommodating portion 15) is used as the inner diameter of the diameter-increased portion.

Figure 9:
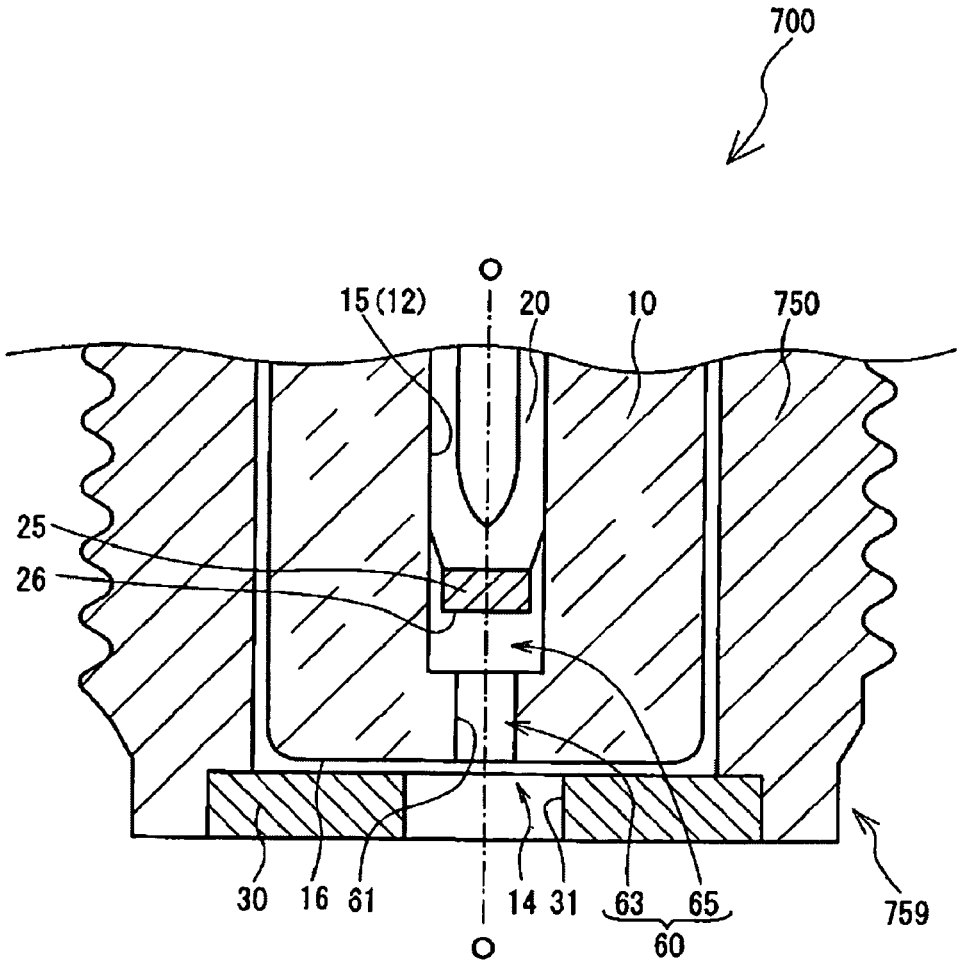
FIG. 9 is a partial sectional view of a plasma jet ignition plug 700 according to another modification.

Further, as in the case of a plasma jet ignition plug 700 shown in FIG. 9, the ground electrode 30 attached to a front end portion 759 of a metallic shell 750 is not necessarily required to be in close contact with the front end face 16 of the insulator 10, and a clearance may be provided between the ground electrode 30 and the front end face 16. Such a clearance hardly influences the igniting performance of the plug, because the jetting direction of the plasma formed within the cavity 60 is aligned with the direction of the axis O by the constricted portion 63.

Figure 10:
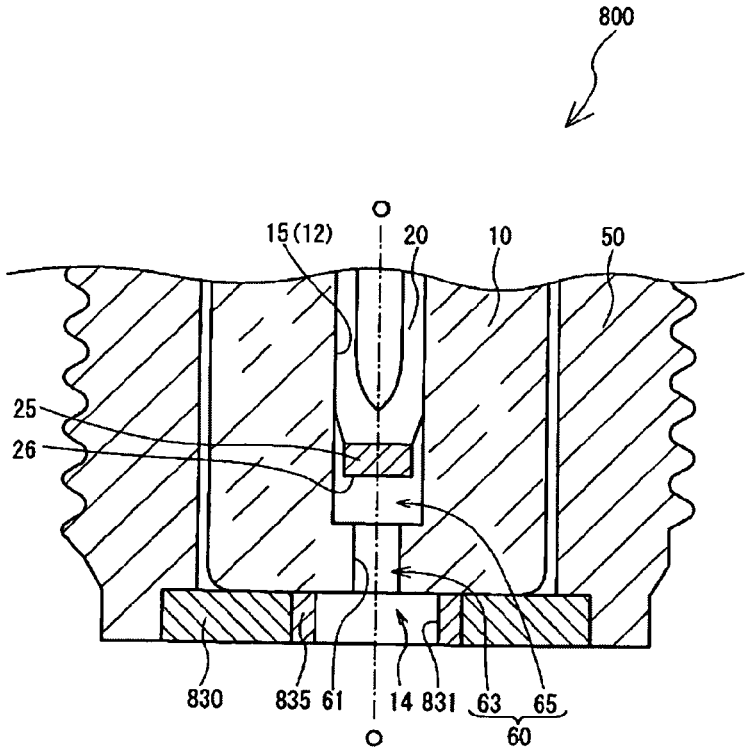
FIG. 10 is a partial sectional view of a plasma jet ignition plug 800 according to another modification.

Further, as in the case of a plasma jet ignition plug 800 shown in FIG. 10, the inner wall of a communication hole 831 of a ground electrode 830 may be formed by an electrode chip 835 made of an alloy which contains a noble metal and/or W as a predominant component. Since high energy is supplied between the ground electrode and the center electrode of the plasma jet ignition plug, provision of such an electrode chip onto the ground electrode and/or the center electrode can improve the resistance to spark-induced erosion, to thereby extend the service life of the plasma jet ignition plug.

Further, the front-end small-diameter portion 61 of the axial bore 12, which constitutes the cavity 60, is not necessarily required to have a diameter smaller than that of the electrode-accommodating portion 15. The front-end small-diameter portion 61 may have a diameter equal to the diameter of the electrode-accommodating portion 15 so long as the lengths X, Y and inner diameters A, B of the diameter-increased portion 65 and the constricted portion 63 satisfy the above-described requirements. Alternatively, the front-end small-diameter portion 61 may have a diameter greater than the diameter of the electrode-accommodating portion 15.

Further, the scheme of the ignition apparatus 120 is not limited to the scheme employed in the present embodiment and adapted to superimpose the energy from the capacitor on trigger discharge, and may be any of other ignition schemes such as a CDI scheme, a full-transistor scheme, a point (contact) scheme, and the like.

Having described the invention, the following is claimed:

1. A plasma jet ignition plug comprising:

a center electrode;

an insulator which has an axial bore extending along an axial direction for holding the center electrode while accommodating a front end face of the center electrode within the axial bore, and a recess formed on the front-end side of the axial bore as a cavity, the recess having a wall surface defined by an inner circumferential surface of the axial bore and the front end face of the center electrode and having a volume less than 15 $mm^3$;

a metallic shell surrounding and holding a radially outer circumference of the insulator; and a ground electrode electrically connected to the metallic shell and provided on the front end side of the insulator, plasma being generated within the recess as a result of discharge between the center electrode and the ground electrode, wherein the recess of the insulator is composed of a constricted portion which has at least a portion extending along the axial direction while maintaining a certain diameter and communicates with an opening provided at the front end of the insulator, and a diameter-increased portion which communicates with the constricted portion, which is larger in diameter than the constricted portion, and in which the front end face of the center electrode is exposed;

the recess satisfies a relation $X \leqq Y$ where X represents a length of the diameter-increased portion as measured along the axial direction, and Y represents a length of the constricted portion as measured along the axial direction; and the ground electrode is a plate-shaped electrode which has a communication hole for establishing communication between the recess and the atmosphere, and satisfies a relation $Z<X+Y \leqq 3.0$ mm, where Z represents a thickness of the ground electrode as measured along the axial direction.

2. A plasma jet ignition plug according to claim 1, wherein the recess satisfies a relation $A \leqq \phi 4.0$ mm and a relation $\phi 0.5$ mm $\leqq B \leqq \phi 1.5$ mm, where A represents an inner diameter of a part of the diameter-increased portion which part is the largest in inner diameter, and B represents an inner diameter of a part of the constricted portion which part is the smallest in inner diameter.

3. A plasma jet ignition plug according to claim 2, wherein a relation $X \leqq A$ is satisfied.

4. A plasma jet ignition plug according to claim 2, wherein a relation $B \leqq C$ is satisfied, where C represents an inner diameter of the communication hole of the ground electrode.

5. A plasma jet ignition plug according to claim 2, wherein a relation $0 \leqq D-B \leqq 2$ (mm) is satisfied, where D represents an outer diameter of a front end portion of the center electrode.

6. A plasma jet ignition plug according to claim 1, wherein a relation $0.01 < S/V \leqq 0.4$ is satisfied, where S represents a cross sectional area ($mm^2$) of the constricted portion as measured perpendicularly to the axial direction, and V represents a volume V ($mm^3$) of the recess.

7. An ignition device for a plasma jet ignition plug, comprising:

the plasma jet ignition plug comprising:

a center electrode;

an insulator which has an axial bore extending along an axial direction for holding the center electrode while accommodating a front end face of the center electrode within the axial bore, and a recess formed on the front-end side of the axial bore as a cavity, the recess having a wall surface defined by an inner circumferential surface of the axial bore and the front end face of the center electrode and having a volume less than 15 $mm^3$;

a metallic shell surrounding and holding a radially outer circumference of the insulator; and a ground electrode electrically connected to the metallic shell and provided on the front end side of the insulator, plasma being generated within the recess as a result of discharge between the center electrode and the ground electrode, wherein the recess of the insulator is composed of a constricted portion which has at least a portion extending along the axial direction while maintaining a certain diameter and communicates with an opening provided at the front end of the insulator, and a diameter-increased portion which communicates with the constricted portion, which is larger in diameter than the constricted portion, and in which the front end face of the center electrode is exposed;

the recess satisfies a relation $X \leqq Y$ where X represents a length of the diameter-increased portion as measured along the axial direction, and Y represents a length of the constricted portion as measured along the axial direction;

the ground electrode is a plate-shaped electrode which has a communication hole for establishing communication between the recess and the atmosphere, and satisfies a relation $Z < X+Y \leqq 3.0$ mm, where Z represents a thickness of the ground electrode as measured along the axial direction; and a relation $0.01 < S/V \leqq 0.4$ is satisfied, where S represents a cross sectional area ($mm^2$) of the constricted portion as measured perpendicularly to the axial direction, and V represents a volume V ($mm^3$) of the recess; and a power source which supplies an energy for ignition to the plasma jet ignition plug, wherein a relation $3 \leqq E/V \leqq 200$ is satisfied, where E represents an amount of energy E (mJ) supplied from the power source.

* * * * *